US011460026B2

(12) United States Patent
Mikulic et al.

(10) Patent No.: US 11,460,026 B2
(45) **Date of Patent: *Oct. 4, 2022**

(54) COMPRESSOR UNIT AND METHOD FOR OPERATING A COMPRESSOR UNIT

(71) Applicant: BITZER Kuehlmaschinenbau GmbH, Sindelfingen (DE)

(72) Inventors: Tihomir Mikulic, Holzgerlingen (DE); Roni Loerch, Neuenbuerg (DE); Klaus Feller, Herrenberg (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 424 days.

This patent is subject to a terminal disclaimer.

(21) Appl. No.: 16/152,079

(22) Filed: Oct. 4, 2018

(65) Prior Publication Data

US 2019/0032655 A1 Jan. 31, 2019

Related U.S. Application Data

(63) Continuation of application No. PCT/EP2016/057538, filed on Apr. 6, 2016.

(51) Int. Cl.

| | |
|---|---|
| ***F04C 18/16*** | (2006.01) |
| ***F04C 28/28*** | (2006.01) |
| ***F04C 28/12*** | (2006.01) |
| ***F04C 29/02*** | (2006.01) |
| *F04C 28/06* | (2006.01) |

(52) U.S. Cl.

CPC ..... *F04C 18/16* (2013.01); *F04C 28/12* (2013.01); *F04C 28/28* (2013.01); *F04C 29/02* (2013.01);

(Continued)

(58) Field of Classification Search

CPC ..... F04C 18/16; F04C 28/06; F04C 28/12; F04C 28/28; F04C 29/02; F04C 2240/81;

(Continued)

(56) References Cited

U.S. PATENT DOCUMENTS 3,936,239 A * 2/1976 Shaw ..... F04C 28/125 417/315
4,609,329 A * 9/1986 Pillis ..... F04C 28/125 417/282

(Continued)

FOREIGN PATENT DOCUMENTS

DE 32 21 849 A1 12/1983
DE 102012102349 A1 9/2013

(Continued)

*Primary Examiner* — Devon C Kramer
*Assistant Examiner* — Joseph S. Herrmann
(74) *Attorney, Agent, or Firm* — Reinhart Boerner Van Deuren P.C.

(57) ABSTRACT

A compressor unit including a screw compressor having a compressor housing that has a screw rotor chamber arranged in the compressor housing, two screw rotors that are arranged in the screw rotor chamber and are mounted on the compressor housing to be rotatable about a respective screw rotor axis, and at least one control slider, which is arranged in a slider channel of the compressor housing, is adjacent to both screw rotors and is movable in a direction of displacement parallel to the screw rotor axes and takes a form such that it affects the final volume and/or the initial volume, wherein there is provided on the screw compressor a compressor operational control unit that takes a form such that it performs a compressor operating function that assists at least one operation of the compressor unit.

27 Claims, 17 Drawing Sheets

(52) U.S. Cl.
CPC ..... *F04C 28/06* (2013.01); *F04C 2270/18* (2013.01); *F04C 2270/19* (2013.01); *F04C 2270/60* (2013.01)

(58) Field of Classification Search
CPC ..... F04C 2270/18; F04C 2270/19; F04C 2270/60
See application file for complete search history.

(56) References Cited

U.S. PATENT DOCUMENTS

| | | | | |
|---|---|---|---|---|
| 4,611,976 | A * | 9/1986 | Schibbye | F04C 28/125 418/159 |
| 4,990,058 | A * | 2/1991 | Eslinger | F04B 9/113 417/18 |
| 5,183,395 | A * | 2/1993 | Langouet | F04C 28/125 417/310 |
| 5,257,921 | A | 11/1993 | Clarke et al. | |
| 10,794,382 | B2 * | 10/2020 | Loerch | F04C 18/16 |
| 2005/0013702 | A1 | 1/2005 | Dieterich et al. | |
| 2015/0004015 | A1 * | 1/2015 | Kienzle | F01N 1/083 417/312 |
| 2015/0292762 | A1 * | 10/2015 | Clanin | G05B 15/02 700/276 |
| 2016/0245288 | A1 * | 8/2016 | Yano | F04B 49/06 |

FOREIGN PATENT DOCUMENTS

| | | | |
|---|---|---|---|
| EP | 1498611 | A1 | 1/2005 |
| WO | WO 03/019010 | A1 | 3/2003 |

* cited by examiner

Position 100% output, maximum Vi

Position with partial load of 75%

Position with partial load of 50%

Position with partial load of 25%

COMPRESSOR UNIT AND METHOD FOR OPERATING A COMPRESSOR UNIT

CROSS-REFERENCE TO RELATED PATENT APPLICATION

This application is a continuation of International application number PCT/EP2016/057538 filed on Apr. 6, 2016.

This patent application claims the benefit of International application No. PCT/EP2016/057538 of Apr. 6, 2016 the teachings and disclosure of which are hereby incorporated in their entirety by reference thereto.

BACKGROUND OF THE INVENTION

The invention relates to a compressor unit, including a screw compressor having a compressor housing that has a screw rotor chamber arranged in the compressor housing, at least one screw rotor that is arranged in the screw rotor chamber, is mounted on the compressor housing to be rotatable about a screw rotor axis and receives gaseous medium having an initial volume that is supplied by way of a low-pressure chamber arranged in the compressor housing and discharges it, compressed to a final volume, in the region of a high-pressure chamber arranged in the compressor housing, and at least one control slider, which is arranged in a slider channel of the compressor housing, is adjacent to the screw rotor and is movable in a direction of displacement parallel to the screw rotor axis and takes a form such that it affects the final volume and/or the initial volume.

Compressor units of this kind are known from the prior art, wherein compressor units having screw compressors require considerable expertise to use them, because of the complexity of the functional interactions of these screw compressors.

The object of the invention is therefore to improve a compressor unit of the kind mentioned in the introduction such that it is usable with as little functional expertise as possible in respect of the functional interactions of the screw compressor.

SUMMARY OF THE INVENTION

This object is achieved according to the invention in the case of a compressor unit of the kind mentioned in the introduction in that there is provided on the screw compressor a compressor operational control unit that takes a form such that it performs at least one compressor operating function that assists operation of the compressor unit.

Thus, the advantage of the solution according to the invention can be seen in the fact that it is possible as a result of the compressor operational control unit to use it to perform compressor operating functions that assist operation of the compressor, that is to say that take over individual functions that are important for operation of the compressor such that the compressor unit can be used in a system with little outside effort.

In particular, compressor units of this kind are provided for compressing refrigerant in refrigerating circuits of refrigeration systems, wherein refrigeration systems of this kind are conventionally provided with a complex controller.

Thus, with the present solution according to the invention, the installation of refrigeration systems of this kind is simplified and/or made easier, since the manufacturer of refrigeration systems is no longer compelled to implement the entirety of the complex functional interactions for a compressor unit of this kind in the system controller if the compressor unit already implements functional interactions of this kind using the compressor operational control unit.

This means that a refrigeration system engineer can reduce in particular the control of the refrigeration system to communicating to the compressor operational functional unit one or more request signals for operation of the compressor unit, and then having the compressor operational control unit convert these request signals in accordance with the compressor operating functions to be implemented.

The most diverse possibilities are conceivable as regards the compressor operating functions to be taken over by the compressor operational control unit.

An advantageous solution provides for the at least one compressor operating function to be a parameter determining function, and, in particular for the purpose of performing the parameter determining function, for at least one of the function parameters to be determined, such as: pressure of the medium on the input side of the screw compressor, temperature of the medium on the input side of the screw compressor, pressure of the medium on the output side of the screw compressor, temperature of the medium on the output side of the screw compressor, position of the at least one control slider, position of all the control sliders, lubricant temperature, lubricant flow rate, lubricant differential pressure at the lubricant filter, lubricant level in at least one lubricant supply line, speed of rotation of the drive motor, phasing of the drive motor, temperature of the drive motor, voltage at the drive motor, current consumption of the drive motor.

The advantage of this solution can be seen in the fact that, by determining at least one or more of these function parameters, it is possible to obtain sufficient information on the respective operating state of the screw compressor for the complex functional interactions in a screw compressor to be determinable in a simple manner.

It is particularly advantageous if a further compressor operating function is a protective function, if for the purpose of performing the protective function at least one parameter determining function is performed and the at least one function parameter is compared with at least one reference parameter, and if, in the event of the value exceeding or falling below the at least one reference parameter, a warning message is given and/or the screw compressor is switched off.

A protective function of this kind has the advantage that it allows operation of the compressor unit to be performed reliably without the need for external units or external functional modules, for example in the system controller, to ensure reliable operation of the screw compressor.

In particular, with a protective function of this kind, all the function parameters that are essential for the respective operating states are checked and compared with reference parameters.

For example, it is conceivable to compare the parameters such as pressure and/or temperature of the medium on the input side and pressure and/or temperature of the medium on the output side with a usage chart for the screw compressor, wherein the limits of use in the usage chart at the same time represent reference values for pressure and/or temperature on the input side and the output side so that it may be ensured for example that the screw compressor is operated within its limits of use.

Further, in the context of the protective function it is for example conceivable to determine the lubricant temperature and in particular to compare it with a or with an upper and a lower reference value in order to ensure sufficient lubrication.

Further, it is conceivable for example in the context of the solution according to the invention to determine the lubricant level in at least one lubricant supply line and, in the absence of lubricant in at least one lubricant supply line, to switch off the screw compressor in order to avoid damaging it.

Finally, it is for example likewise provided within the context of a protective function to monitor the temperature of the drive motor to avoid damaging it.

However, the same applies for example to the voltage and current consumption of the drive motor.

Moreover, a further advantageous embodiment of the compressor unit according to the invention provides for the at least one compressor operating function to be a control function, and, in particular for the purpose of performing the control function, for at least one of the units to be controlled, such as: a control slider drive for the control sliders, a motor controller, a lubricant cooling unit, and an injection element for compressed medium for the purpose of additional cooling.

The advantage of a compressor operating function of this kind taking the form of a control function can be seen in the fact that as a result the compressor operational control unit is able, for example on the basis of one or more predetermined values, to operate the screw compressor in the provided operating state, in particular by controlling the control sliders to adjust the volume ratio corresponding to the operating state and the compressor output corresponding to the operating state.

Moreover, it is for example also advantageous if a motor controller is controllable in order to allow in particular the speed of rotation of the screw rotors to be predetermined.

In principle, the control function could be performed independently of the request signals and/or function parameters, for example only in accordance with one or more predetermined values.

However, a particularly advantageous solution provides, if the at least one compressor operating function is an operating state predetermining function in which a control function is performed on the basis of at least one request signal and/or at least one function parameter.

A further advantageous solution provides for the compressor operating function to be an operating state monitoring function, and, in particular for the purpose of performing the operating state monitoring function, for the performance of at least one parameter determining function and/or at least one protective function and/or at least one control function to be recorded.

Recording the compressor operating functions in this way provides the possibility of monitoring the operating states of the compressor unit according to the invention throughout operation thereof and to identify the fact that the respectively permitted operating states have been even briefly exceeded, or indeed to identify the fact that the respective limits in a usage chart have been exceeded.

Moreover, the operating state monitoring function also has the advantage that in the event of faults there is a simple way to determine the cause of the fault on the basis of the recorded compressor operating functions.

Here, it is particularly favourable if the recording of the at least one function parameter and/or the performance of at least one protective function and/or the performance of the at least one control function take place over time, such that a time-resolved analysis of operating states in the past is possible, which in particular in the event of faults makes fault location simpler.

In order to be able to communicate with the compressor operational control unit in a simple manner, it is preferably provided for the compressor operational control unit to be provided with a communication unit for the purpose of exchanging data with external devices.

Such an exchange of data with external devices might be for example an exchange of data with a system controller or indeed an exchange of data with a display and/or operating unit that opens up the possibility of monitoring the individual functions of the compressor operational control unit and/or analysing the operating states of the screw compressor.

Preferably here, the communication unit takes a form such that it exchanges the data by a wired route and/or wirelessly, such that data communication with the compressor operational control unit is simplified.

In particular here, it is advantageous if the compressor operational control unit is provided with a display unit that shows at least one performance state of at least one compressor operating function or the result thereof, such that this allows the compressor operating functions to be monitored in a simple manner.

A further advantageous solution provides for the screw compressor to have a controller housing in which the compressor operational control unit is arranged.

This solution has the great advantage that it makes it possible for the manufacturer to connect the compressor operational control unit to the sensors or units for determining the function parameters, and to the units provided for the control function, with the result that when the compressor unit is used connections of this kind have already been made by the manufacturer and for example only the communication with the compressor operational control unit need be made.

Here, it is particularly favourable if the controller housing is arranged on the compressor housing.

More detailed statements have not been made above as regards the construction of the screw compressor.

In particular, a screw compressor includes a compressor housing that has a screw rotor chamber arranged therein, two screw rotors that are arranged in the screw rotor chamber, are mounted on the compressor housing to be rotatable about a respective screw rotor axis, engage in one another by their helical contours and each interact with compression wall surfaces that are adjacent to and partly surround the helical contours in order to receive gaseous medium that is supplied by way of a low-pressure chamber arranged in the compressor housing and to discharge it in the region of a high-pressure chamber arranged in the compressor housing, wherein the gaseous medium is enclosed, at low pressure and with an initial volume, in compression wall surfaces formed compression chambers formed between the helical contours and compression wall surfaces adjacent thereto, and is compressed to a final volume at high pressure, and at least one control slider, which is arranged in a slider channel of the compressor housing, is adjacent to both screw rotors by slider compression wall surfaces, and is movable in a direction of displacement parallel to the screw rotor axes and takes a form such that it affects the final volume and/or the initial volume.

In particular, it is advantageously provided, for the purpose of determining the exact position of the at least one control slider, for the screw compressor to take a form such that a position determining device is provided for the at least one control slider, for the position determining device to have a position indicator element coupled to the at least one control slider, for the at least one position indicator element to interact with a detector element that extends parallel to the direction of displacement of the control slider and along which the position indicator element is movable during movement of the at least one control slider, and for the detector element to be coupled to an evaluation device that determines the respective position of the position indicator element along the detector element.

The advantage of this solution can be seen in particular in the fact that it makes very precise position indication of the control sliders possible with a simple construction.

In particular, in the case of a screw compressor that has two control sliders, wherein a first control slider takes a form such that it affects at least the final volume and a second control slider takes a form such that it affects at least the initial volume, it is provided for a position determining device for the two control sliders to be provided that includes a first position indicator element coupled to the first control slider and a second position indicator element coupled to the second control slider, for both position indicator elements to interact with a common detector element that extends parallel to the direction of displacement of the control sliders and along which the position indicator elements are movable during movement of the control sliders, and for the detector element to be coupled to an evaluation device that determines the respective positions of the first position indicator element and the second position indicator element along the detector element.

This solution has the great advantage that it makes it possible, even if there are two control sliders, to determine their positions exactly and in particular at the same time, in particular with a single detector element.

More detailed statements have not yet been made as regards the arrangement of the detector element.

Here, an advantageous solution provides for the detector element to be arranged in a detector channel that extends inside the compressor housing, parallel to the direction of displacement, such that the detector element is optimally protected from outside influences by the detector channel inside the compressor housing.

It is particularly advantageous if the detector channel is closed by a cover such that simple access to the detector channel is possible by way of the cover.

More detailed statements have not yet been made as regards the form taken by the detector channel.

Here, an advantageous solution provides for the detector channel to be formed by a groove-like recess in a housing basic body, above which the cover extends.

Another advantageous solution provides for the cover itself to have a groove-like recess contributing to the detector channel.

So that the detector element having the cover can be assembled simply, an advantageous solution provides for the detector element to extend within the recess in the cover such that the detector element is removable together with the cover, and where appropriate replaceable.

Further, it is preferably provided for the at least one position indicator element to be arranged in the detector channel and to be movable therein in the direction of displacement.

More detailed statements have not yet been made as regards the coupling of the at least one position indicator element to the at least one control slider.

Here, in theory the coupling between the position indicator element and the control slider could be contactless.

For the purpose of reliable position indication of the at least one control slider, however, it is advantageous if the at least one position indicator element is mechanically coupled to the respective control slider by way of a connection body, and the position indicator element is thus rigidly entrained with the respective control slider.

In order to make the connection between the respective position indicator element, which is movable in the detector channel, and the control slider, it is preferably provided for the respective connection body to pass through an elongate passage between the detector channel and a slider channel that receives the at least one control slider.

It is particularly favourable if the respective connection body and the passage together guide the respective control slider non-rotatably in the direction of displacement such that a non-rotatable guidance of the control sliders is producible at the same time without the need for separate guidance by a groove in the control slider and a groove block in the compressor housing.

More detail has not yet been given as regards the interaction between the at least one position indicator element and the detector element.

Here, a particularly advantageous solution provides for the respective position indicator element to interact with the detector element in contactless manner, such that the position indicator elements can determine position in a manner free from wear.

Preferably here, the detector element is made from a magnetostrictive material, and the position indicator element generates, at its location, a local magnetic flux of the detector element that can then be determined in the detector element by way of the evaluation circuit.

A particularly favourable solution provides a compressor operational control unit that controls a control slider drive for the respective control slider and determines a movement of the respective control slider using the position determining unit.

Thus, the compressor operational control unit is able not only to move the respective control slider with the control slider drive but also exactly to follow the performed movement.

This is particularly advantageous if the control slider drive takes the form of a cylinder arrangement configured to be urged by a medium.

The compressor operational control unit can be used particularly advantageously if it positions the respective control slider with position control.

This means that the compressor operational control unit on the one hand controls the control slider drive and on the other hand can determine, by determining the position of the respective control slider, whether the desired position has been reached or not, and can then also move precisely to this position by a corresponding further control of the control slider drive, and for example maintain this position over the long term.

It is thus possible, using a compressor control program of the compressor operational control unit, to predetermine individual positions of the respective control slider or where appropriate plurality of control sliders, and then to move to and maintain these with position control, using the compressor operational control unit, such that any desired intermediate positions between the extreme positions are possible in order to operate the screw compressor optimally.

In particular, it is advantageous if, when determining the positions of the at least one control slider, the compressor operational control unit takes into account at least one or more of the parameters, such as: pressure level on the input side, in particular at low pressure, pressure level on the output side, in particular at high pressure, temperature of the gaseous medium on the input side, in particular at low pressure, temperature of the gaseous medium on the output side, in particular at high pressure, speed of rotation of the screw rotors, power consumption of a drive motor, parameters of the gaseous medium, in particular of the refrigerant, and values of limits of use of the screw compressor.

More detailed statements have not yet been made as regards the arrangement of two control sliders in relation to one another.

Here, it is advantageously provided for the first control slider and the second control slider to be arranged one behind the other in the direction of displacement thereof.

If there are two control sliders arranged one behind the other, it is provided in particular for the first control slider and the second control slider to have identical external contours.

Preferably, two control sliders lying one behind the other are usable such that the first control slider and the second control slider are positionable directly succeeding one another in a combined position and are movable together in the direction of displacement.

As an alternative thereto, in the case of two control sliders lying one behind the other, it is possible for the first and the second control slider to be positionable in a separated position, spaced from one another, forming an intermediate space.

As an alternative to providing two control sliders lying one behind the other, a further advantageous solution provides for the first control slider to have mutually directly adjacent slider compression wall surfaces, of which in each case one faces one of the screw rotors, and for the second control slider to have compression wall surface regions that are arranged spaced from one another, of which in each case one is adjacent to one of the screw rotors, and between which the slider compression wall surfaces of the first control slider lie.

With such an arrangement of two control sliders, it is possible preferably to affect the final volume using the first control slider and to affect the initial volume using the second control slider, by way of the slider compression wall surfaces that are arranged spaced from one another.

Preferably here, it is provided for the first control slider to be mounted on the second control slider.

Preferably here, the first control slider is mounted in a slider channel of the second control slider.

Moreover, it is preferably provided for the slider compression wall surfaces of the first control slider and the slider compression wall surfaces of the second control slider to succeed one another.

In particular, in the case of the two control sliders arranged one behind the other, it is provided for the first control slider and the second control slider to have identical external contours.

A solution of this kind makes it possible, in a particularly simple manner, to guide the two control sliders in a common slider channel.

Further, the two control sliders lying one behind the other are advantageously to be used such that the first control slider and the second control slider are positionable directly succeeding one another in a combined position and are movable together in the direction of displacement.

Further, in the case of the two control sliders lying one behind the other, it is provided for the first and the second control slider to be positionable in a separated position, spaced from one another, forming an intermediate space.

Further, the invention relates to a method for operating compressor unit, including a screw compressor having a compressor housing that has a screw rotor chamber arranged in the compressor housing, at least one screw rotor that is arranged in the screw rotor chamber, is mounted on the compressor housing to be rotatable about a screw rotor axis and receives gaseous medium having an initial volume that is supplied by way of a low-pressure chamber arranged in the compressor housing and discharges it, compressed to a final volume, in the region of a high-pressure chamber arranged in the compressor housing, and at least one control slider, which is arranged in a slider channel of the compressor housing, is adjacent to the screw rotor and is moved in a direction of displacement parallel to the screw rotor axis, and the final volume and/or the initial volume is affected, wherein according to the invention there is provided on the screw compressor a compressor operational control unit that is used to perform a compressor operating function that assists an operation of the compressor unit.

An advantageous variant of the method provides for the at least one compressor operating function to be a parameter determining function, and, in particular for the purpose of performing the parameter determining function, for at least one of the function parameters to be determined, such as:

pressure of the medium on the input side of the screw compressor,
temperature of the medium on the input side of the screw compressor,
pressure of the medium on the output side of the screw compressor,
temperature of the medium on the output side of the screw compressor,
position of the at least one control slider,
position of all the control sliders,
lubricant temperature,
lubricant flow rate,
lubricant differential pressure at the lubricant filter,
lubricant level in at least one lubricant supply line,
speed of rotation of the drive motor,
temperature of the drive motor,
phasing of the drive motor,
voltage at the drive motor,
current consumption of the drive motor.

A further advantageous variant of the method provides for a further compressor operating function to be a protective function, for the purpose of performing the protective function for at least one parameter determining function to be performed, and for the at least one function parameter to be compared with at least one reference parameter, and, in the event of the value exceeding or falling below the at least one reference parameter, for a warning message to be given and/or for the screw compressor to be switched off.

An advantageous variant of the method provides for the at least one compressor operating function to be a control function, and, in particular for the purpose of performing the control function, for at least one of the units to be controlled, such as:

a control slider drive,
a motor controller,
a lubricant cooling unit,
an injection element for compressed medium for the purpose of additional cooling,
slider control unit for the control sliders.

In particular, in a variant of the method it is advantageous that the at least one compressor operating function is an operating state predetermining function in which a control function is performed on the basis of at least one request signal and/or at least one function parameter.

Further, in a variant of the method it is provided for the compressor operating function to be an operating state monitoring function, and, in particular for the purpose of performing the operating state monitoring function, for the performance of at least one parameter determining function and/or at least one protective function and/or at least one control function to be recorded.

For the purpose of monitoring, a variant of the method takes a form such that the recording of the at least one function parameter and/or the performance of at least one protective function and/or the performance of the at least one control function take place over time.

For the purpose of communication, in a variant of the method it is provided for the compressor operational control unit to be provided with a communication unit that exchanges data with external devices, wherein the communication unit exchanges the data in particular by a wired route and/or wirelessly.

Moreover, in a variant of the method it is favourable if the compressor operational control unit having at least one display unit shows at least one performance state of at least one compressor operating function or the result thereof.

Further variants of the method according to the invention become apparent from the features explained above in connection with the compressor unit.

Further features and advantages of the invention form the subject matter of the description below and the representation in the drawing of some exemplary embodiments.

DETAILED DESCRIPTION OF THE INVENTION

Figure 1:
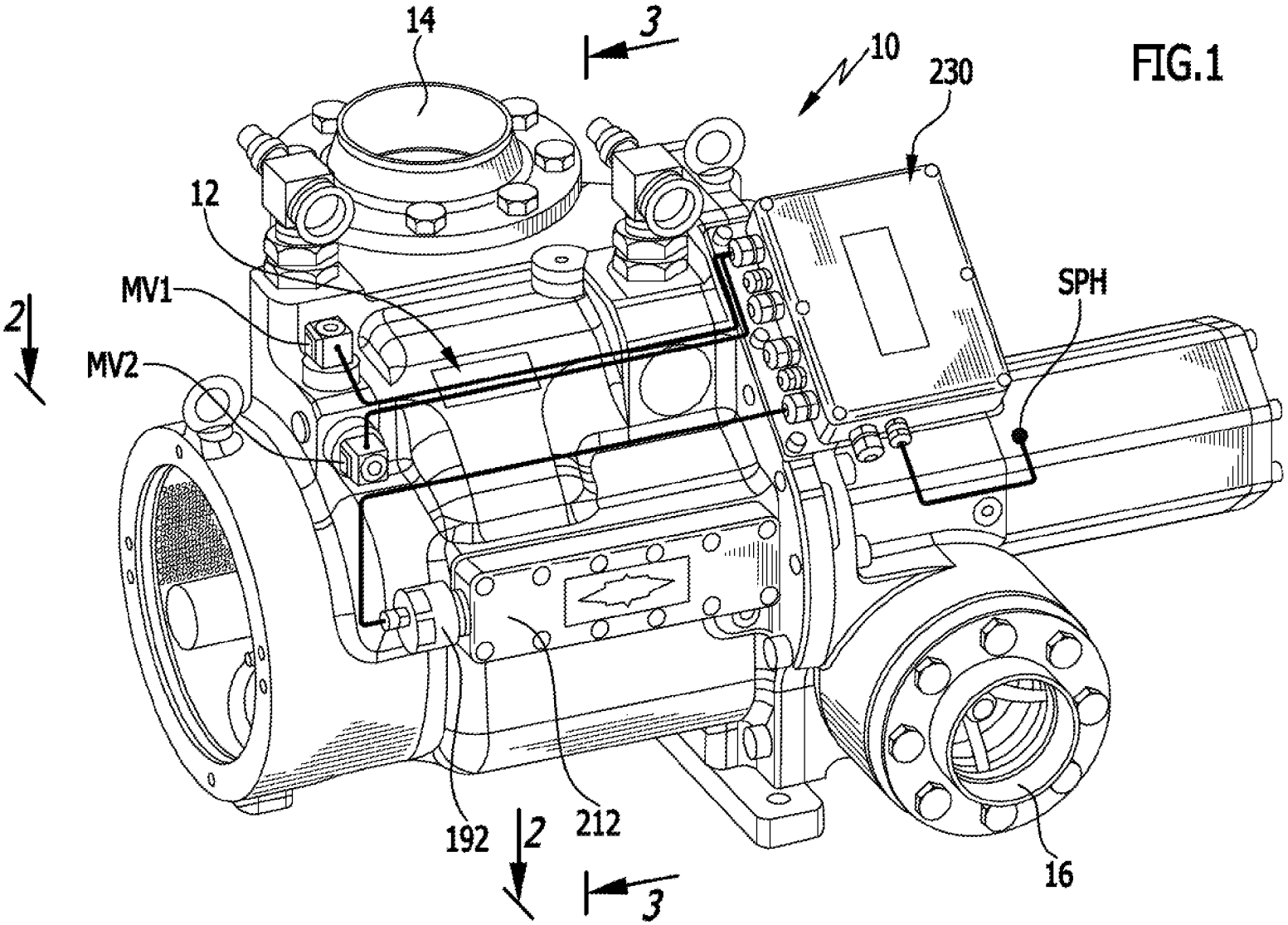
FIG. 1 shows a perspective view of a first exemplary embodiment of a screw compressor according to the invention.

A first exemplary embodiment, illustrated in FIG. 1, of a screw compressor 10 according to the invention includes a compressor housing that is designated 12 as a whole and that has an intake connector 14 through which a gaseous medium to be drawn in, in particular refrigerant, is drawn in and that has a pressure connector 16 through which the gaseous medium that has been compressed to high pressure, in particular the refrigerant, is discharged.

Figure 2:
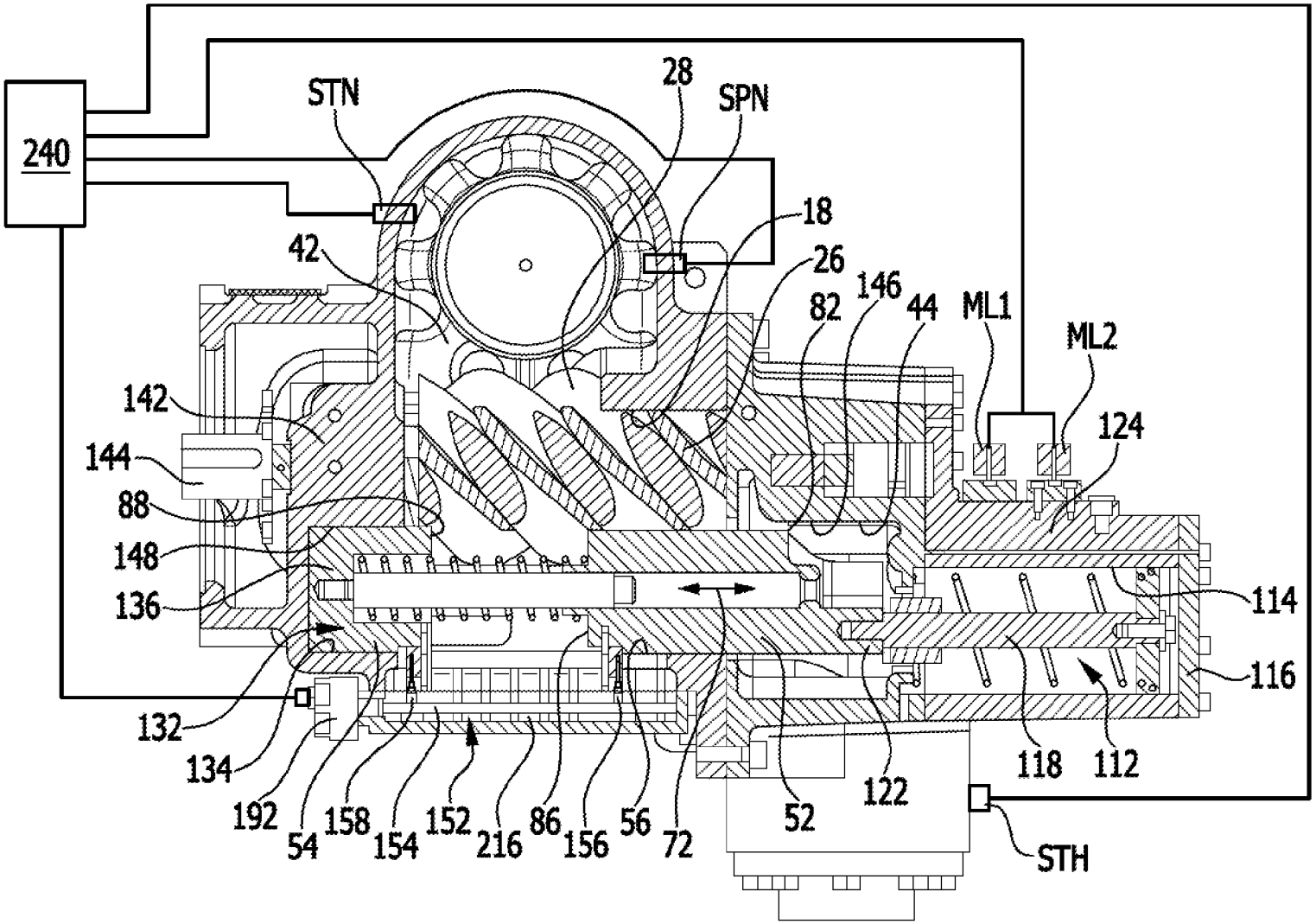
FIG. 2 shows a section along the line 2-2 in FIG. 1.
Figure 3:
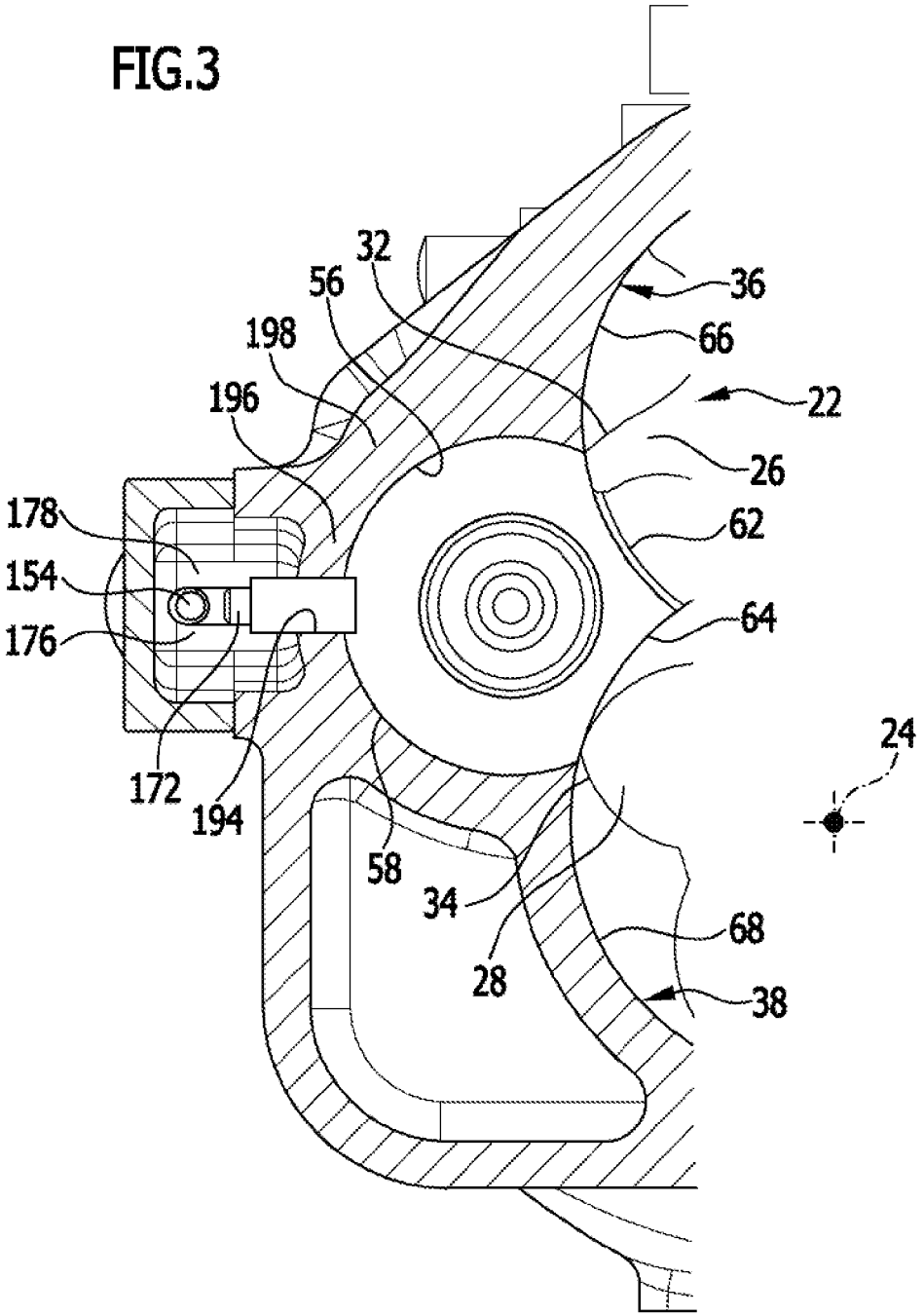
FIG. 3 shows a section along the line 3-3, in the region of a position determining device.

As illustrated in FIGS. 2 and 3, provided in a screw rotor chamber 18 of the compressor housing 12 are two screw rotors 26, 28 that are rotatable about a respective screw rotor axis 22, 24 and engage in one another by means of their helical contours 32 and 34 and interact with compression wall surfaces 36 and 38 respectively of the screw rotor chamber 18 which are peripherally adjacent to the helical contours 32, 34, in order to receive gaseous medium that is supplied to a low-pressure chamber 42 adjacent to the helical contours 32, 34 on the intake side, to compress it and to discharge it at high pressure into a high-pressure chamber 44 in the compressor housing 12.

Here, the gaseous medium, in particular refrigerant, is enclosed in compression chambers, which are formed between the helical contours 32, 34 and the compression wall surfaces 36, 38 adjacent thereto, with an intake volume at low pressure and is compressed to a final volume at high pressure.

For the purpose of adapting the screw compressor 10, for example to the operating conditions required in a refrigerating circuit, the operating state of the screw compressor 10 is adapted on the one hand in respect of the volume ratio, which is the relationship between the maximum enclosed intake volume and the expelled final volume, and on the other in respect of the compressor output, which is the proportion of the volumetric flow that is actually compressed by the screw compressor in relation to the maximum volumetric flow that is compressible by the screw compressor 10.

For the purpose of adapting the operating state, in a first exemplary embodiment that is illustrated in FIG. 2 to FIG. 8, a first control slider 52 and a second control slider 54 are arranged one behind the other in a slider channel 56 that is provided in the compressor housing 12, wherein the slider channel 56 extends parallel to the screw rotor axes 22, 24 and guides the first control slider 52 and the second control slider 54 in the region of their guide peripheral surface 58 that is not adjacent to the screw rotors 26, 28.

The first control slider 52 faces the high-pressure chamber 44 and is thus arranged on the high-pressure side, and the second control slider 54 is arranged on the low-pressure side in relation to the first control slider 52.

Each of the two control sliders 52 and 54 further has a slider compression wall surface 62 adjacent to the screw rotor 26, and a slider compression wall surface 64 adjacent to the screw rotor 28, and these represent partial surfaces of the compression wall surfaces 36 and 38; and housing compression wall surfaces 66 and 68, which are formed by the compressor housing 12 and likewise represent partial surfaces of the compression wall surfaces 36 and 38, supplement the compression wall surfaces 36 and 38, which together with the helical contours 32 and 34 contribute to forming the compression chambers.

As illustrated in FIG. 2 and FIGS. 4 to 8, the first control slider 52 and the second control slider 54 take a form such that, to the extent that they form the slider compression wall surfaces 62 and 64 and the guide peripheral surface 58, they are identical and can thus be guided displaceably and in a direction of displacement 72 parallel to the screw rotor axes 22, 24, within the slider channel 56 of the compressor housing 12.

Here, the first control slider 52 forms an outlet edge 82, which faces the high-pressure chamber 44, establishes the final volume of the compression chambers, is displaceable by displacing the first control slider 52 in the direction of displacement 72 and, as a result of its location in relation to a terminal surface 84 of the screw rotor chamber 18 on the high-pressure side, sets the final volume of the compression chambers that are formed and thus the volume ratio.

This principle of a slider arrangement is known and described for example in WO 93/18307, to which the reader is referred in respect of the description of the principle of functioning.

Figure 4:
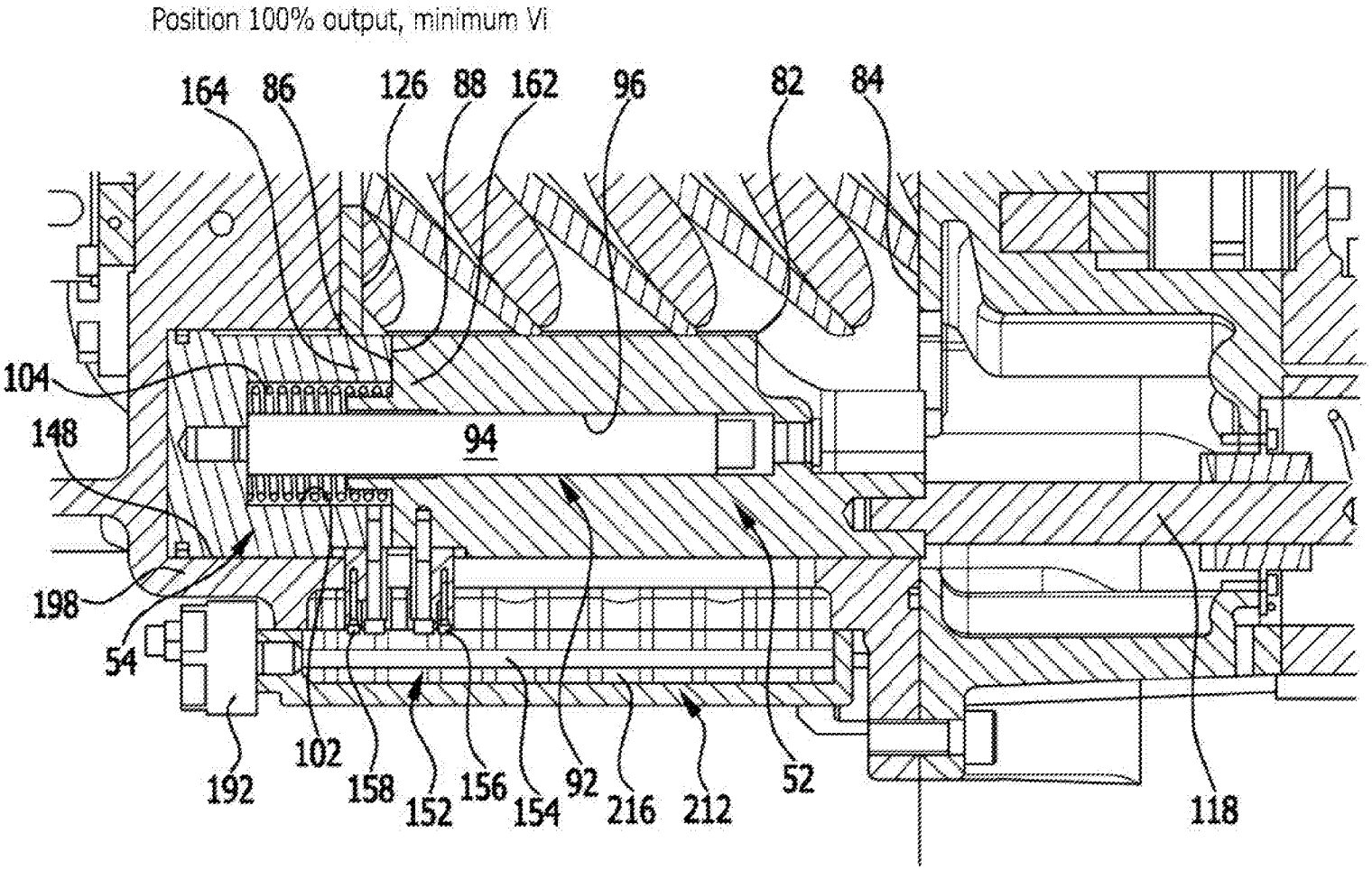
FIG. 4 shows a section similar to FIG. 2 and on a larger scale, in the region of the position determining device and the control sliders, with the maximum output and the minimum volume ratio.
Figure 5:
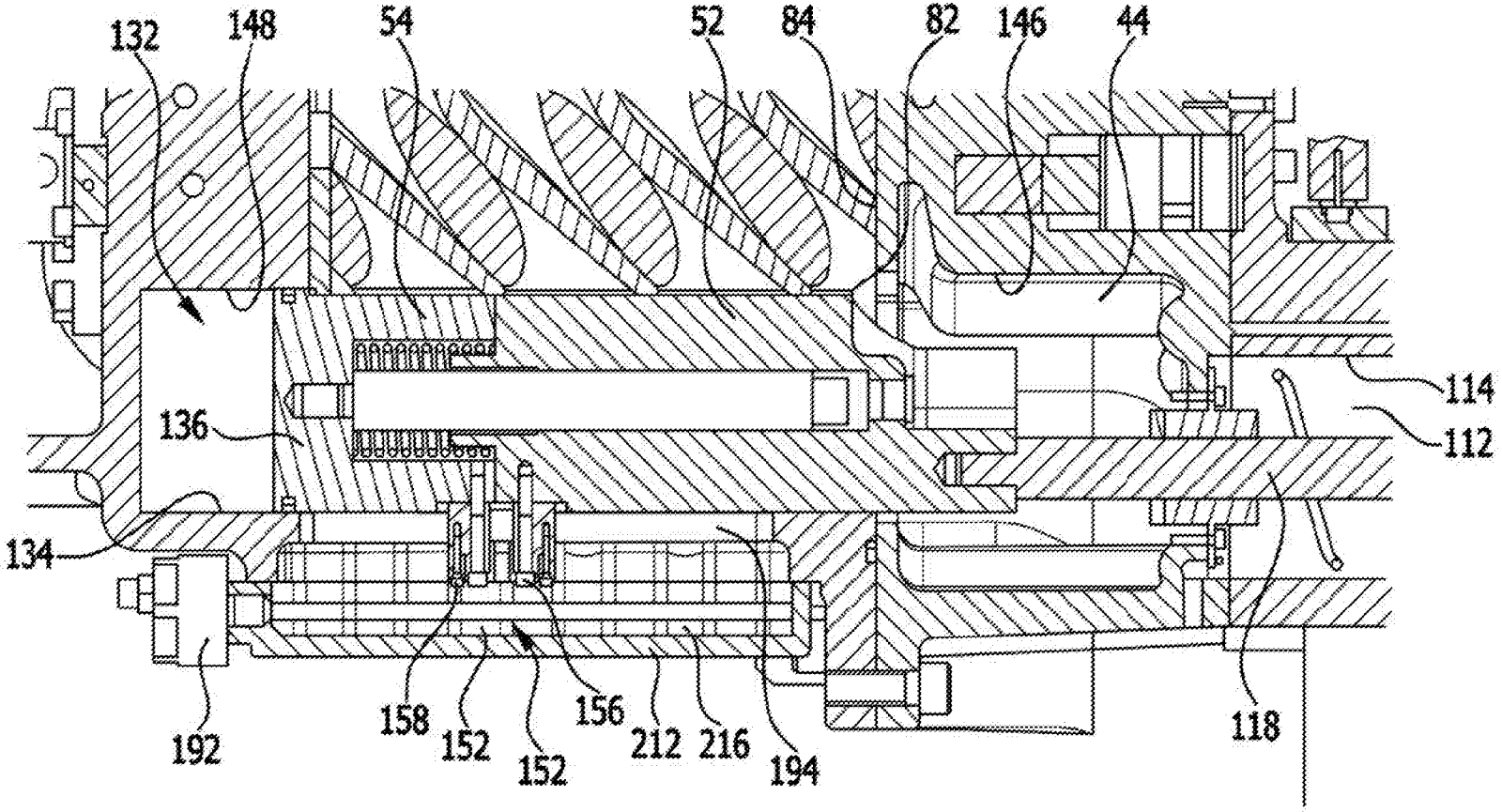
FIG. 5 shows an illustration similar to FIG. 4, with the maximum conveying volume and the maximum volume ratio.

As illustrated in FIG. 2 and FIGS. 4 to 8, the first control slider 52 and the second control slider 54 have mutually facing end surfaces 86 and 88 by means of which they are configured to abut against one another, as illustrated for example in FIG. 4 and FIG. 5, such that the slider compression wall surfaces 62 and 64 of the first control slider 52 and the second control slider 54 merge into one another.

Further, and in addition to the slider channel 56, the first control slider 52 and the second control slider 54 are guided in relation to one another by a telescopic guide 92 that has an inner guide body 94 and a guide receptacle 96, wherein the guide receptacle 96 is provided in the first control slider 52 and the guide body 94 is held on the second control slider 54 and projects beyond the end surface 88 thereof such that this can engage in the guide receptacle 96 in the first control slider 52.

Further, and preferably also in an inner chamber 102 of the second control slider 54 surrounding the guide body 94, a pressure spring 104 is provided that serves to urge the first control slider 52 in relation to the second control slider 54 such that the end surfaces 86 and 88 are movable away from one another.

For the purpose of displacing the first control slider 52 there is provided, as illustrated in FIG. 2, a control slider drive, for example taking the form of a cylinder arrangement 112, wherein the cylinder arrangement 112 includes a cylinder chamber 114 and a piston 116, wherein the piston 116 is connected to a piston rod 118 that makes a connection with the first control slider 52, for example with an extension 122 of the first control slider 52 that is arranged for example on an opposite side thereof to the end surface 86.

Further, the cylinder arrangement 112 is located in particular on an opposite side of the first control slider 52 to the second control slider 54, preferably in a housing portion 124 of the compressor housing 12 that is on the high-pressure side and is arranged to succeed the slider channel 56 and to succeed the high-pressure chamber 44 and thus on an opposite side of the compressor housing 12 to the low-pressure chamber 42.

The second control slider 54 is displaceable by a control slider drive, for example taking the form of a cylinder arrangement 132, wherein the cylinder arrangement 132 includes a piston 136 which is movable in a cylinder chamber 134, and wherein the cylinder chamber 134 extends in particular, as an extension of the slider channel 56, in a housing portion 142 that is on the low-pressure side and in which there are arranged bearing units on the drive side for the screw rotors 26 and 28, which are for example drivable by way of a drive shaft 144.

In particular, the piston 136 is integrally formed in one piece with the second control slider 54 and has a piston surface that corresponds at least to the cross sectional surface area of the second control slider 54.

The housing portion 142 on the low-pressure side, which receives the cylinder chamber 134 for the cylinder arrangement 132 for moving the second control slider 54, is located in a region of the compressor housing 12 that is arranged opposite the housing portion 124 on the high-pressure side, for receiving the cylinder chamber 114 for the cylinder arrangement 112.

The first control slider 52 and the second control slider 54 can be pushed far enough together by the cylinder arrangements 112 and 132 for the end surfaces 86 and 88 to abut against one another in a combined position, and the two control sliders 52, 54 can also move together in the combined position, in the manner of a single control slider that extends from the terminal surface 126 on the intake side in the direction of the terminal surface 84 on the pressure side, and whereof the outlet edge 82 contributes to establishing the volume ratio, with the screw compressor 10 always conveying the maximum volumetric flow in this combined position, as illustrated in FIG. 4.

The volume ratio can be adjusted in dependence on the location of the outlet edge 82 in relation to the terminal surface 84, increasing as the spacing from the outlet edge 82 to the terminal surface 84 decreases, and reaches its maximum value when the outlet edge 82 has the least spacing from the terminal surface 84 that is required for minimising the final volume, as illustrated for example in FIG. 5.

Figure 6:
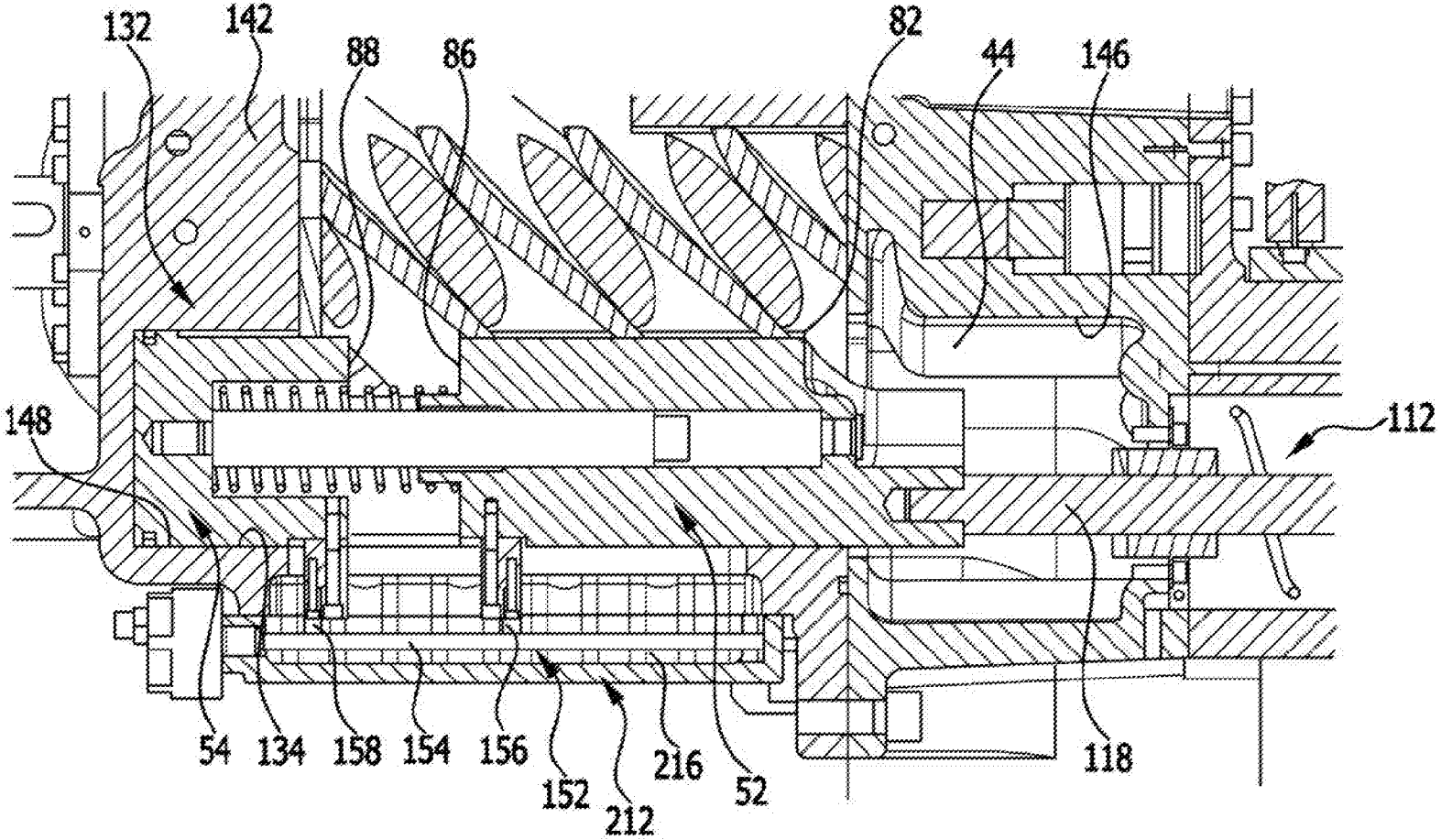
FIG. 6 shows an illustration similar to FIG. 4, with approximately three quarters of the output.

If the compressor output, that is to say the volumetric flow that is actually conveyed, is additionally to vary, then as illustrated for example in FIG. 6 the end surfaces 86 and 88 are separated by moving the control sliders 52 and 54 apart, into a separated position. In the separated position, the second control slider 54 is ineffective, so in the separated position the location of the end surface 86 of the first control slider 52 establishes the initial volume.

Provided the outlet edge 82 is not in a position in which it predetermines the minimum possible final volume, however, the relationship between the initial volume, predetermined by the end surface 86, and the final volume, predetermined by the outlet edge 82, is not variable.

Figure 7:
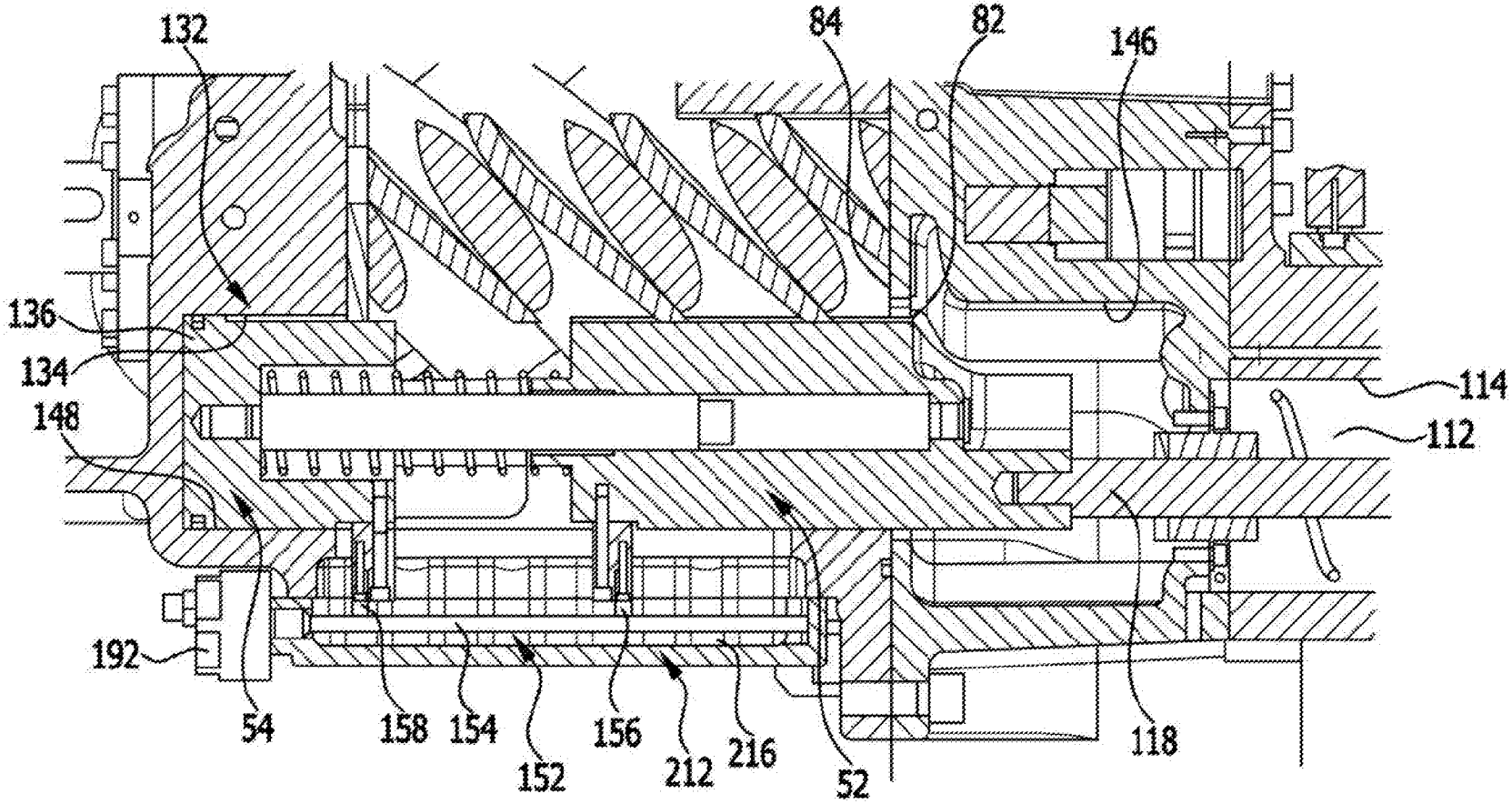
FIG. 7 shows an illustration similar to FIG. 4, with approximately half the output.

If, however, as illustrated in FIG. 7, the first control slider 52 is displaced far enough in the direction of the high-pressure chamber 44 for the outlet edge 82 to have the minimum spacing from the terminal surface 84 or even to be displaced beyond this into a retraction chamber 146, which is surrounded by the high-pressure chamber 44, for the first control slider 52, it is possible to vary the initial volume 86 without changing the final volume, since the latter then continues to remain at a minimum.

In order to eliminate the action of the second control slider 54 in the separated position, it is retracted into the housing portion 142 in particular by the cylinder arrangement 132, wherein the cylinder chamber 134 is dimensioned such that at the same time it includes a retraction chamber 148 for the second control slider 54 and thus provides the possibility of moving the second control slider 54 far enough away from the first control slider 52 for the end surface 88 no longer to affect the initial volume.

Thus, the second control slider 54 enables the initial volume to be affected either in that it abuts by means of its end surface 88 against the end surface 86 of the first control slider 52, for forming the combined position of the control sliders 52, 54, and thus maximises the initial volume, or it can be moved by its own end surface 88 far enough away from the end surface 86 of the first control slider 52 for there to be no further effect of any kind on the initial volume by the second control slider 54.

For determining the positions of the first control slider 52 and the second control slider 54, there is provided a position determining device which is designated 152 as a whole and includes a detector element 154 that extends parallel to the direction of displacement 72 of the control sliders 52, 54 and thus parallel to the screw rotor axes 22, 24, and which is able to determine the positions of position indicator elements 156 and 158.

Figure 9:
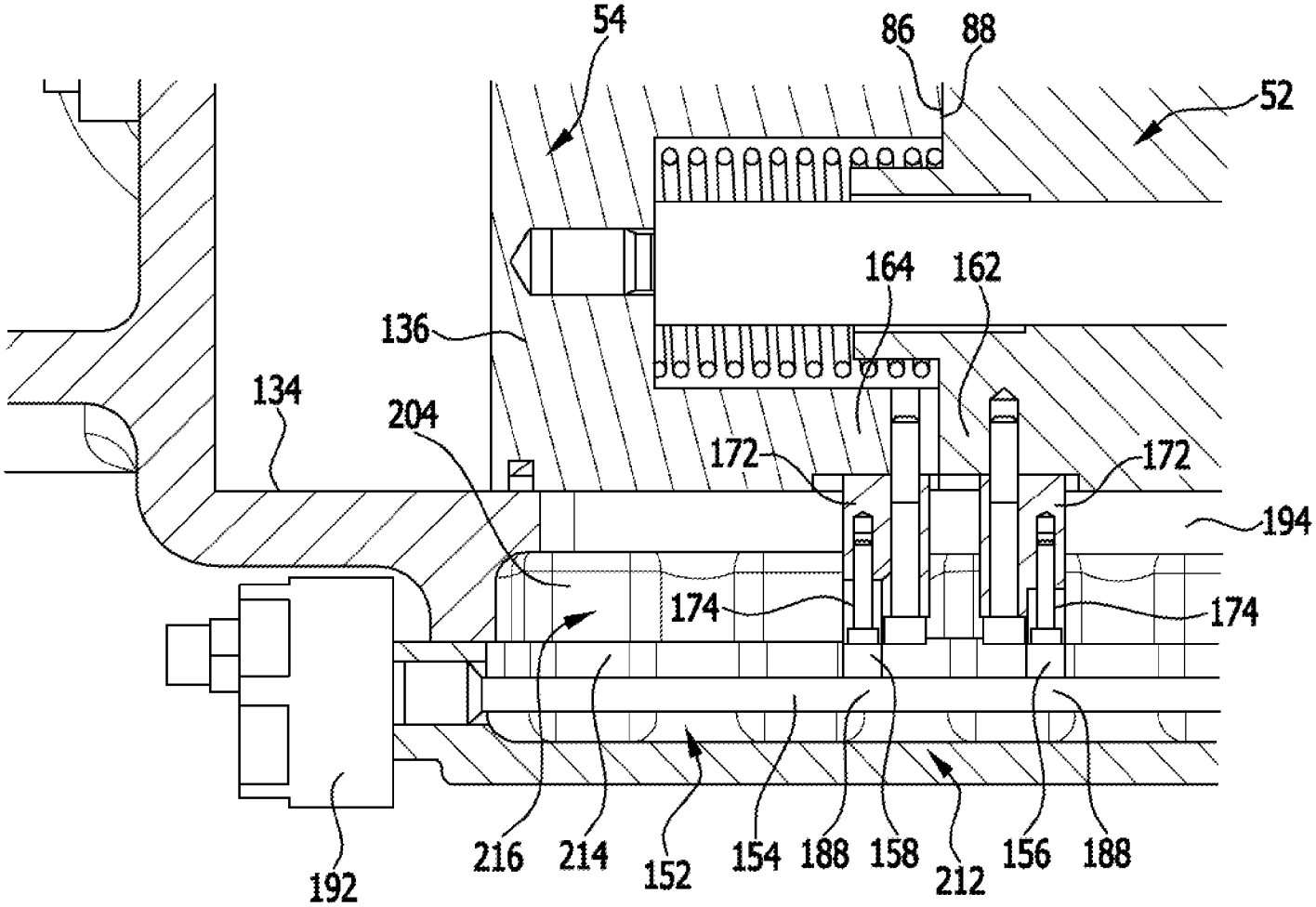
FIG. 9 shows an illustration, on a larger scale, of the position determining unit and the position indicator elements, in connection with the control slider.

Here, the position indicator element 156 is fixedly coupled to the first control slider 52, in particular to an end region 162 of the first control slider 52 that succeeds the end surface 86, and the position indicator element 158 is coupled to the second control slider 54, in particular to an end region 164 thereof that succeeds the end surface 88, as illustrated in particular in FIG. 9.

Figure 10:
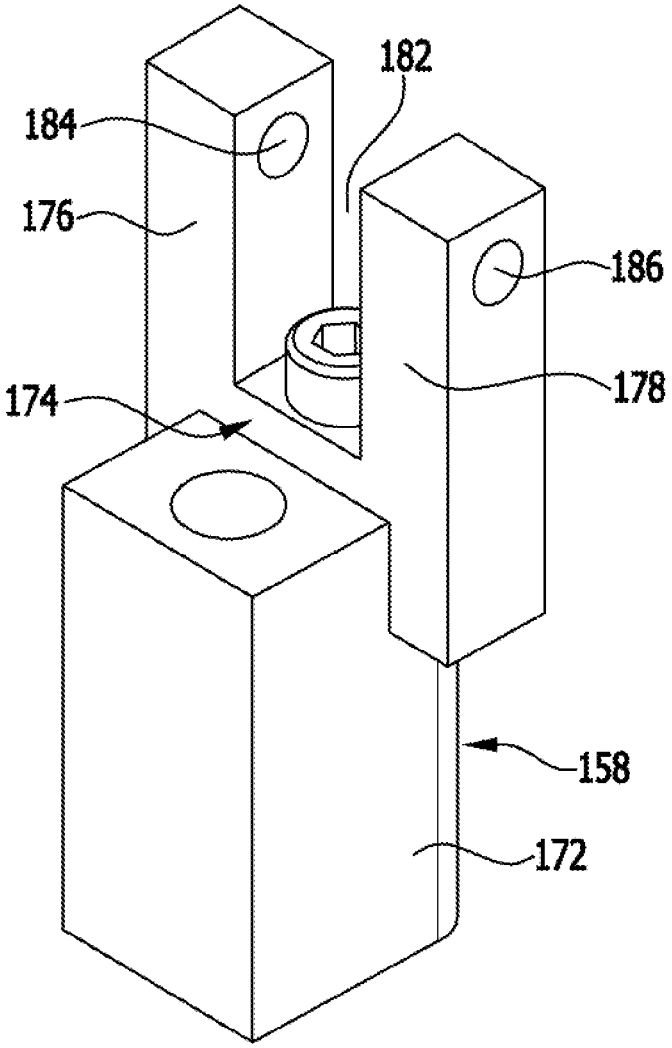
FIG. 10 shows a perspective illustration, on a larger scale, of a position indicator element of the position determining device.
Figure 11:
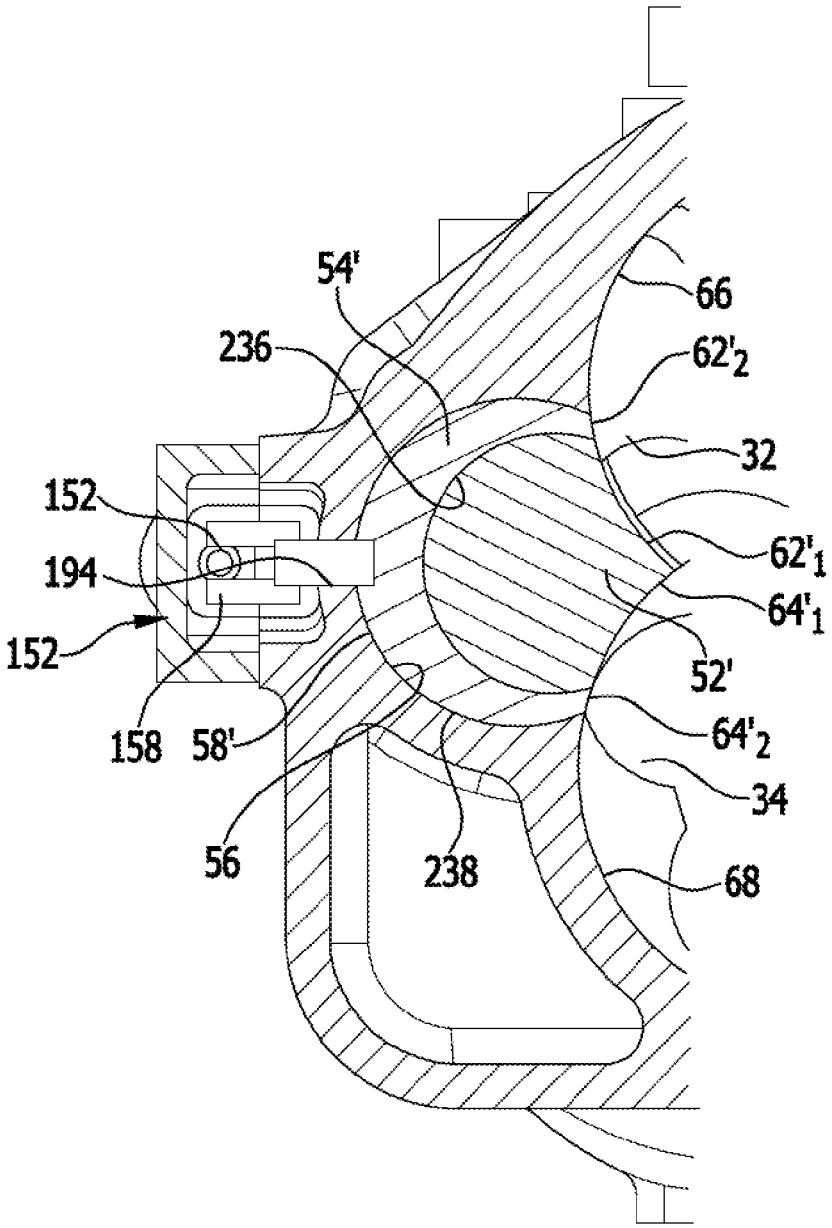
FIG. 11 shows a section similar to FIG. 3, through a second exemplary embodiment of a screw compressor according to the invention, with control sliders arranged within one another.
Figure 12:
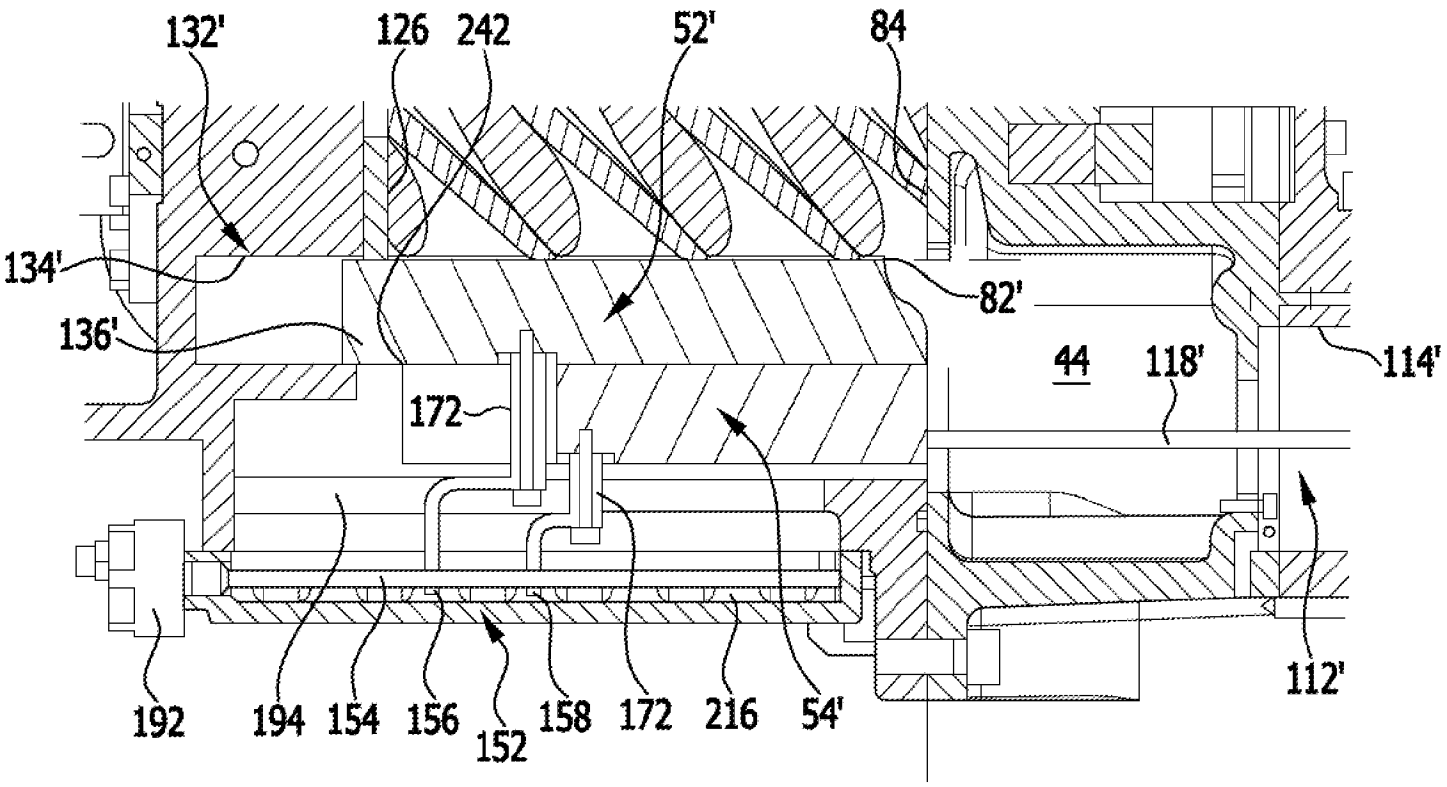
FIG. 12 shows a schematic illustration of the second exemplary embodiment of the screw compressor according to the invention, with control sliders arranged within one another in a manner similar to FIG. 4, with the maximum volume ratio and the maximum output.
Figure 13:
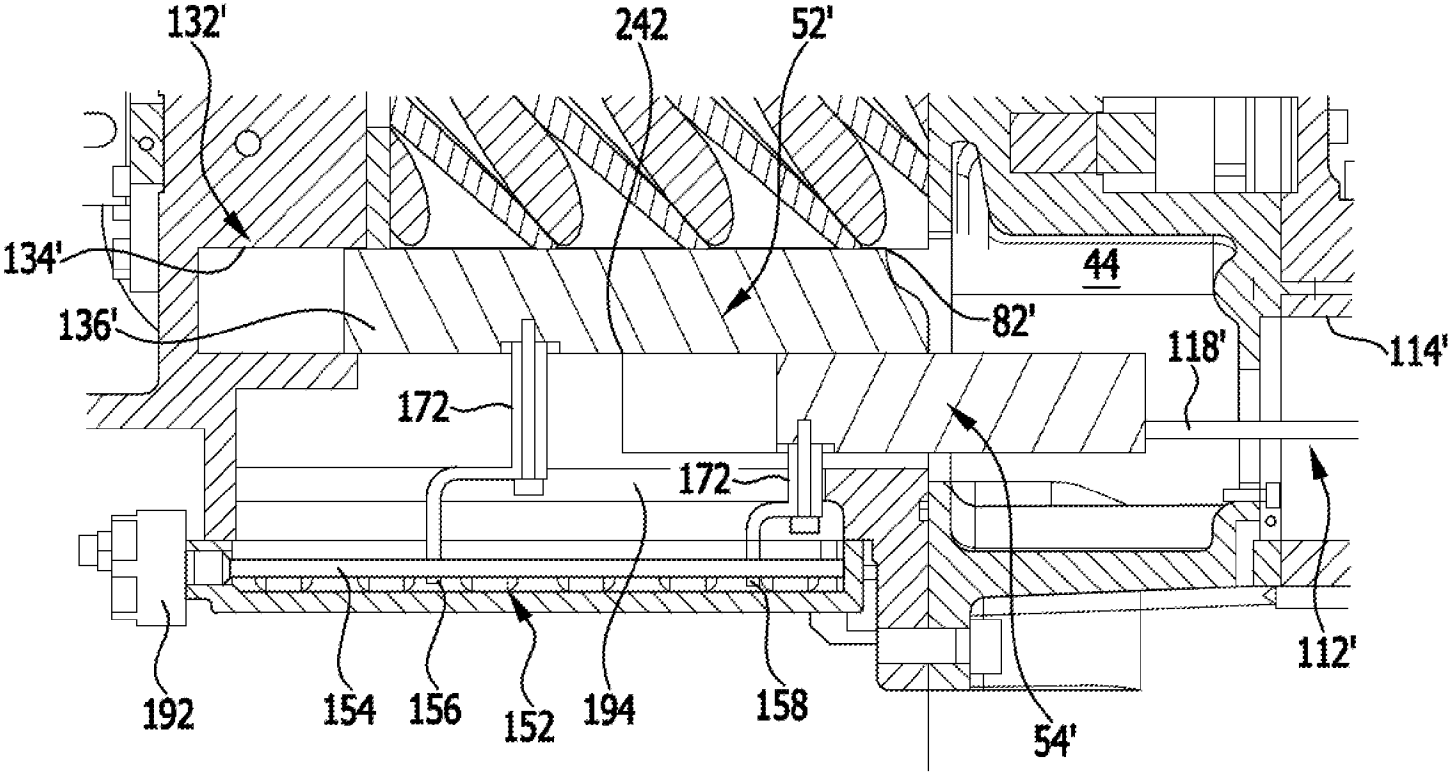
FIG. 13 shows an illustration similar to FIG. 12, with the maximum volume ratio and the minimum output.
Figure 14:
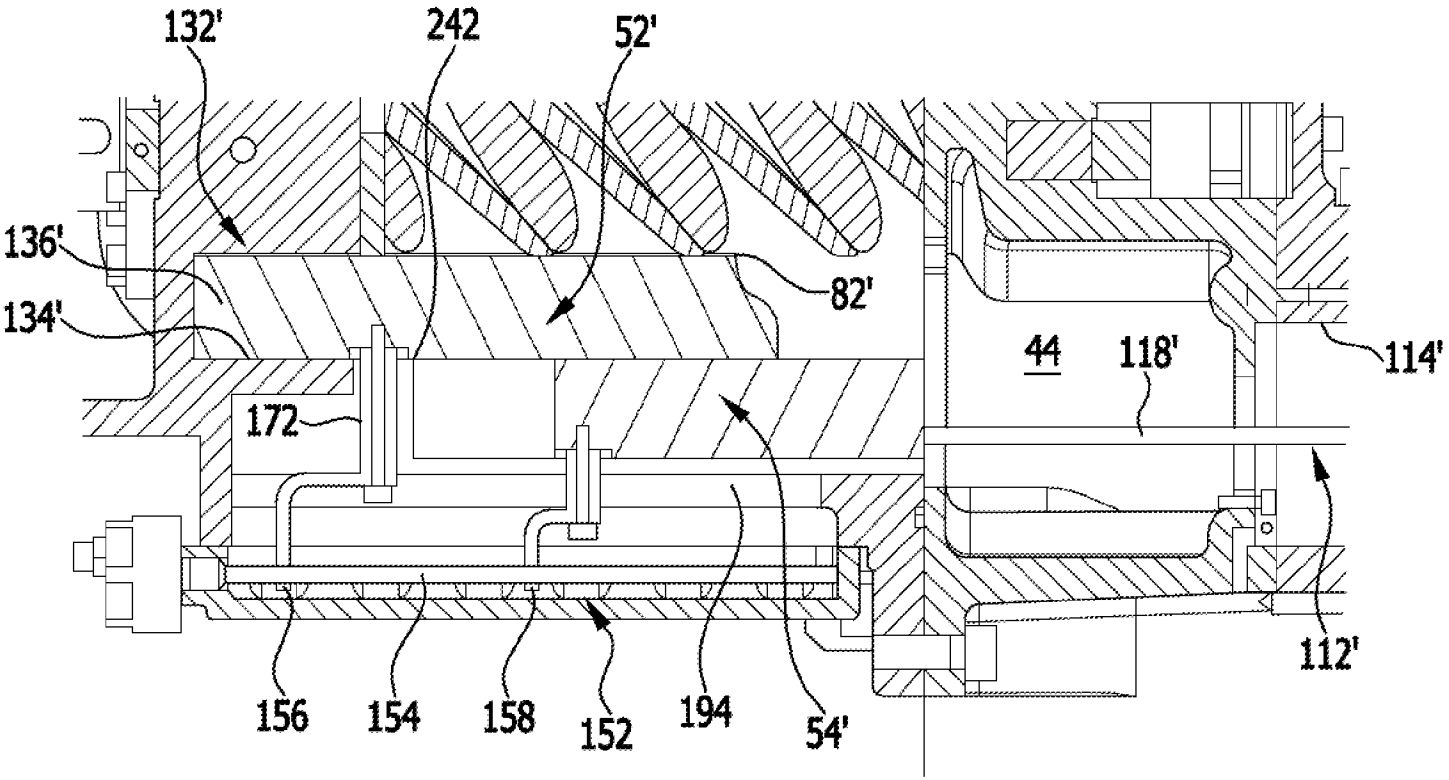
FIG. 14 shows an illustration similar to FIG. 12, with the minimum volume ratio and the maximum output.

As illustrated in FIG. 10, each of these position indicator elements 156 and 158 includes a forked element that is designated 174 as a whole and delimits by means of its two fork limbs 176 and 178 an intermediate space 182 that lies between them and through which the elongate detector element 154 extends. Each of these forked elements 174 is coupled to the corresponding control slider 52, 54 by way of a connection body 172 that is connected to the respective end region 162 or 164.

Preferably, the fork limbs 176 and 178 carry magnets 184 and 186 respectively, of which the magnetic field flows through the detector element 154 at the location of the magnets 184, 186.

Here, the detector element 154 is made from a magnetostrictive material, with the result that the respective location 188 of the magnetic flux of the detector element 154 from the magnets 184, 186 is determinable by means of an evaluation device that is designated 192 as a whole, wherein the evaluation device 192 generates for example in the magnetostrictive detector element 154 acoustic waves that are reflected back at the locations 188 through which the magnetic fields of the magnets 184, 186 flow, with the result that the evaluation device 192 can determine, from the transit time of the reflected acoustic waves, the position of the locations 188 at which there is magnetic flux through the magnetostrictive detector element 154.

In this way, the evaluation device 192 may determine the position POS1 of the first control slider 52 and the position POS2 of the second control slider 54 in the direction of displacement 72 in the slider channel 56.

Figure 8:
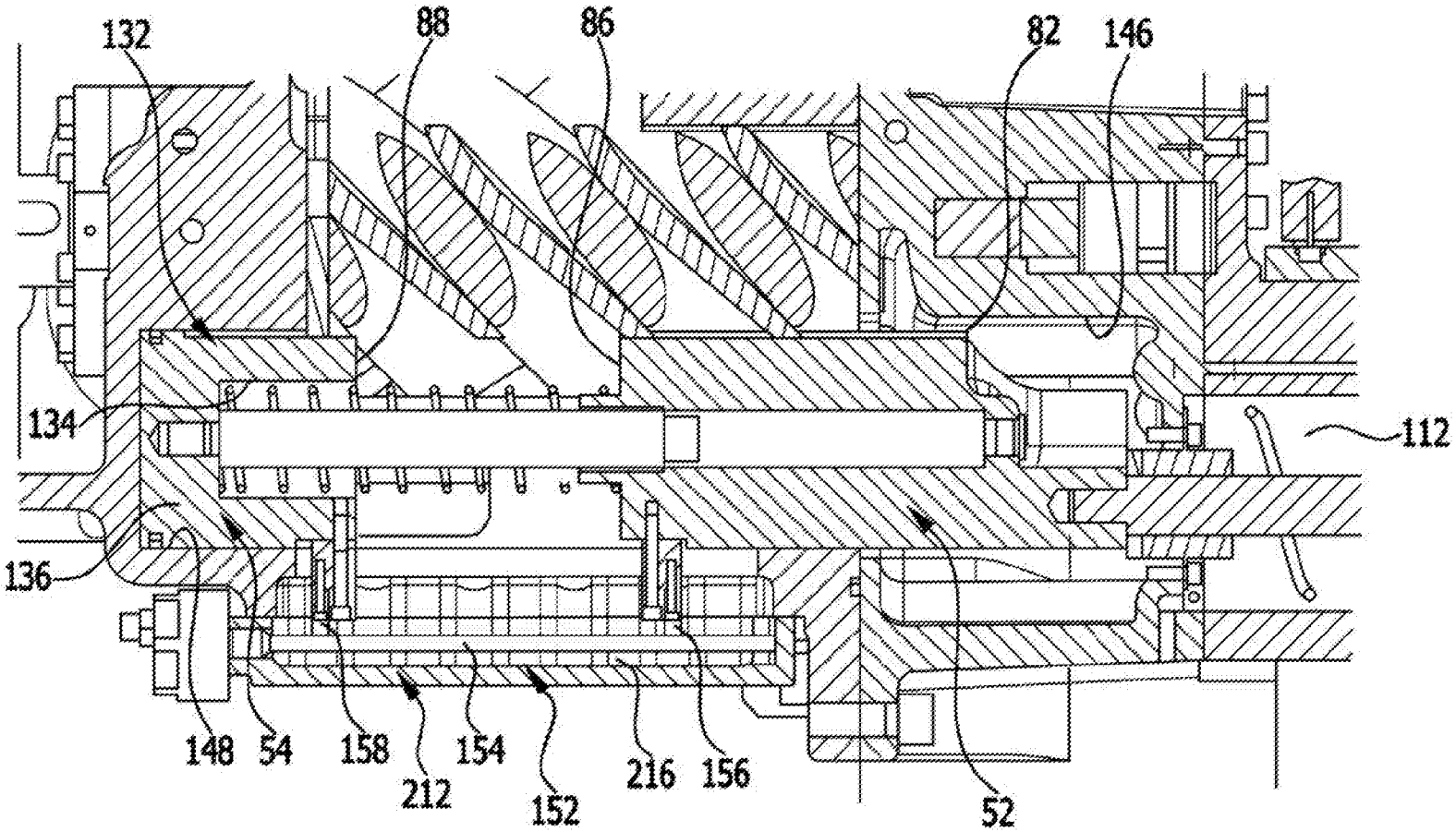
FIG. 8 shows an illustration similar to FIG. 4, with approximately a quarter of the output.

The connection bodies 172, which are held at the respective end regions 162, 164 of the control sliders 52, 54, pass through an elongate, slot-shaped passage 194 which is made in a housing wall 196 forming the slider channel 56 and which has a length that, in the separated position, allows the second control slider 54 to be retracted entirely into the retraction chamber 148 and the first control slider 52 to be positioned with a minimum initial volume, that is to say in a position according to FIG. 8, and the first control slider 52 to be positioned with a minimum volume ratio, that is to say with a maximum spacing of the outlet edge 82 from the terminal surface 84 on the pressure side, and moreover, in the combined position, allows the second control slider 54 to be positioned with the first control slider 52, with maximum volume ratio and minimum volume ratio.

Together with the slot-shaped passage 194, each connection body 172 that is connected to the respective end region 162 and 164 of the corresponding control slider 52 and 54 forms an element preventing rotation of the respective control slider 52, 54, similar to guidance by a groove block and a groove, with the result that there is no need to provide grooves in the control sliders 52, 54 that interact with groove blocks projecting into the slider channel 56.

The passage 194 is always kept at the pressure in the low-pressure chamber 42, and thus also serves to keep the control sliders 52, 54 abutting with their guide peripheral surface 58 against the slider channel 56, with the result that the control sliders 52, 54 cannot press against the screw rotors 26, 28 with the slider compression wall surfaces 62, 64 as a result of high pressure prevailing between the slider channel 56 and the guide peripheral surface 58.

Here, sealing of the passage 194 from relatively high pressures, in particular also the high pressure, is brought about by the narrow tolerance of the gap between the slider channel 56 and the guide peripheral surface 58 of the control sliders 52, 54.

For receiving the forked elements 174 and the detector element 154, there is provided, on an opposite side of a wall 196 of a housing base body 198 to the slider channel 56, a recess 204 that is covered by a cover 212 which itself has a recess 214 facing the recess 204, with the result that the recesses 204 and 214 supplement one another and thus form for example an elongate detector channel 216 which extends parallel to the direction of displacement 72 and in which the detector element 154 extends on the one hand and the forked elements 174 are movable on the other, wherein the forked elements 174 embrace the detector element 154 on both sides by means of their fork limbs 176, 178 and position the magnets 184, 186 such that the magnetic field thereof flows through the detector element 154 at a respective particular location 188.

Preferably, the cover 212 takes a form such that the detector element 154 is located in its recess 214, with the result that the detector element 154, together with the evaluation device 192, is held exclusively on the cover 212 and is removable therewith, whereas the forked elements 174 extend in the detector channel 216, in particular both in the recess 214 and in the recess 204.

In a second exemplary embodiment of a screw compressor according to the invention, the control sliders 52 and 54 take a different form, as illustrated in FIGS. 11 to 14.

In this exemplary embodiment, the second control slider 54' is located in the slider channel 56 and is guided therein by its guide peripheral surface 58'. Further, the second control slider 54' forms external slider compression wall surfaces $\mathbf{62'}_2$ and $\mathbf{64'}_2$ that directly succeed the housing compression wall surfaces 66 and 68, wherein the slider compression wall surface $\mathbf{62'}_2$ is adjacent to the screw rotor 26 and the slider compression wall surface $\mathbf{64'}_2$ is adjacent to the screw rotor 28.

The second control slider 54' in this case takes the form of a crescent moon shape in cross section, with the result that it itself forms a slider channel 236 in which the first control slider 52' is guided by its guide peripheral surface 238.

The first control slider 52' itself forms slider compression wall surfaces $\mathbf{62'}_1$ and $\mathbf{64'}_1$ that are located between the slider compression wall surfaces $\mathbf{62'}_2$ and $\mathbf{64'}_2$ and are directly succeeded by the slider compression wall surfaces 62'$_2$ and 64'$_2$, with the result that the slider compression wall surface 62'$_1$ is adjacent to the screw rotor 26 and the slider compression wall surface 64'$_1$ is adjacent to the screw rotor 28.

In this way, the slider compression wall surfaces 62'$_2$ and 64'$_2$ of the second control slider 54' and the slider compression wall surfaces 62'$_1$ and 64'$_1$ of the first control slider 52' supplement the housing compression wall surfaces 66 and 68 to give the compression wall surfaces 36 and 38 that are arranged surrounding the helical contours 32 and 34 respectively.

The first control slider 52' further forms the outlet edge 82', which is arranged facing the high-pressure chamber 44 and establishes the final volume by its spacing from the terminal surface 84, in a manner comparable to the case in the first exemplary embodiment.

The second control slider 54' affects the initial volume by the position of inlet edges 242 of the slider compression wall surfaces 622 and 642, in particular the spacing thereof from the terminal surface 126 on the low-pressure side.

In this exemplary embodiment, the first control slider 52' is controllable by a cylinder arrangement 132' that is arranged in particular on the intake side, wherein the piston 136' is in this case integrally formed in one piece with the first control slider 52' and is movable in the cylinder chamber 134', while the second control slider 54' is controllable by a cylinder arrangement 112' that is arranged in particular on the pressure side.

A slider arrangement of this kind is known and described for example in DE 32 21 849 A1, to which the reader is referred in respect of the description of the principle of functioning.

In the same way as in the first exemplary embodiment, the positions of the first control slider 52' and the second control slider 54' are determinable by the position determining device 152, wherein likewise position indicator elements 156 and 158 are coupled to the first control slider 52' and the second control slider 54' respectively by way of connection bodies 172 that are fixedly connected to these control sliders 52' and 54' and, in the same way as in the first exemplary embodiment, pass through the passage 194 such that the position indicator elements 156 and 158 are movable along the detector element 154 in the detector channel 216 and, in the same way as in the first exemplary embodiment, the positions of the position indicator elements 156 and 158 may be determined by way of the evaluation device 192.

Here, preferably the position indicator elements 156 and 158 take the form of forked elements 174, in the same way as in the first exemplary embodiment, and are provided with magnets 184 and 186.

Otherwise, in the second exemplary embodiment all the elements that are identical with those of the first exemplary embodiment are provided with the same reference numerals, so the reader may be referred in this regard to the statements made in respect of the first exemplary embodiment in their entirety.

Figure 15:
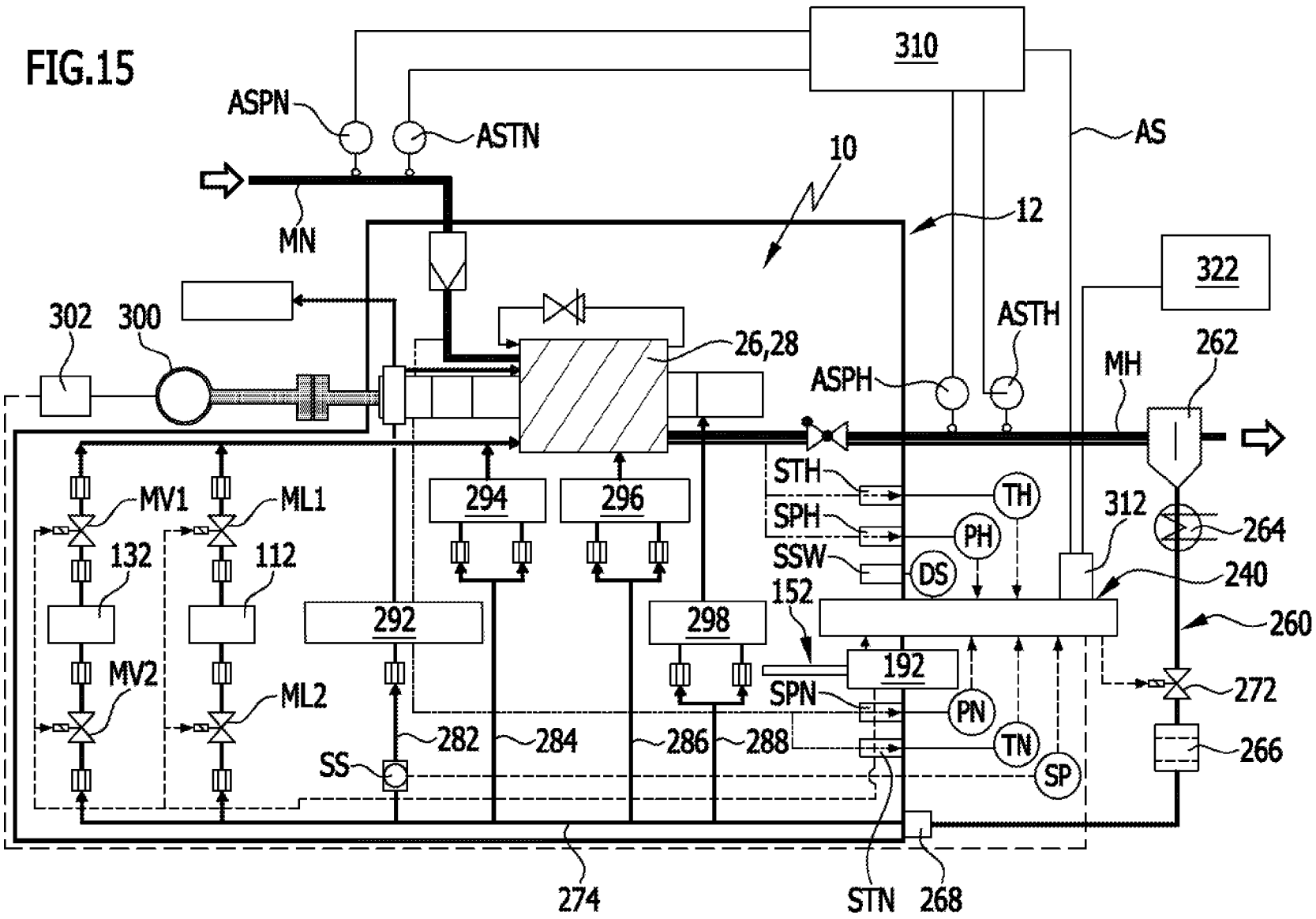
FIG. 15 shows a schematic illustration of a compressor unit of a first embodiment, including a screw compressor according to the first or second exemplary embodiment that is operated using a compressor operational control unit.

Further, as illustrated for example in a first embodiment of a compressor unit in FIG. 15, the screw compressors according to the exemplary embodiments above include a lubricant supply system 260 which uses a lubricant separator 262 to separate off lubricant from a stream of medium MH compressed at high pressure leaving the screw compressor 10, cools this lubricant in a lubricant cooler 264, filters it in a lubricant filter 266 and then supplies it to a lubricant connector 268 on the compressor housing 12, which is illustrated schematically in FIG. 15.

The supply of lubricant is controllable by a controllable valve 272 associated with the lubricant supply system 260.

From the lubricant connector 268, a lubricant inlet line 274 leads to a plurality of lubricant supply lines 282, 284, 286, 288 to feed the lubrication points of the screw compressor 10, for example formed by a shaft seal 292 of the drive shaft for the screw rotors 26, 28, bearings 294 on the low-pressure side for the screw rotors 26, 28, a lubricant injection point 296 for the screw rotors 26, 28 and bearings 298 on the high-pressure side.

Moreover, lubricant can also branch off from the lubricant inlet line 274 for the purpose of operating the cylinder arrangements 112 and 132, since the lubricant is under high pressure.

The lubricant supply system 260 is moreover monitored by a lubricant sensor SS, which is for example associated with one of the lubricant supply lines 282, 284, 286, 288, in this case the lubricant supply line 282.

Preferably, the lubricant sensor SS takes the form of an optical lubricant presence sensor and determines the presence of lubricant, for example in the lubricant supply line 282, in a representative manner for the other lubricant supply lines 284, 286, 288.

For the purpose of secure and reliable operation of one of the above exemplary embodiments of a screw compressor 10, according to the first embodiment of the compressor unit, illustrated in FIG. 15, an electronic compressor operational control unit 240 is provided in a controller housing 230 arranged on the compressor housing 12 and is thus able to perform a multiplicity of compressor operating functions.

A compressor operating function is a parameter determining function according to which for example the following function parameters are determined using sensors and units provided for this purpose.

Using sensors SPN and STN arranged on the input side or low-pressure side, the compressor operational control unit 240 determines respectively the pressure PN of the gaseous medium for compression, on the input side or low-pressure side, and the temperature TN of the gaseous medium for compression, on the input side or low-pressure side of the screw compressor 10.

Further, using sensors SPH and STH arranged on the output side or high-pressure side, the compressor operational control unit 240 determines respectively the pressure PH of the compressed gaseous medium, and the temperature TH of the compressed gaseous medium, on the output side or high-pressure side of the screw compressor 10.

In the context of the parameter determining function, the connection illustrated in FIG. 15 between the compressor operational control unit 240 and the evaluation device 192 is used to determine the positions POS1 and POS2 of the control sliders 52 and 54 respectively, along the direction of displacement 72 in the slider channel 56.

For the purpose of determining the speed of rotation of the screw rotors 26, 28, in the first embodiment according to FIG. 15 a vibration sensor SSW that is connected to the compressor operational control unit 240 is arranged on the compressor housing 12, and this generates a signal DS, which is proportional to the speed of rotation of the screw rotors 26, 28 and is determined by the compressor operational control unit 240.

Moreover, in the context of the parameter determining function, the presence of lubricant is determined as a result of the lubricant presence signal SP of the lubricant sensor SS, which is transmitted to the compressor operational control unit 240 and represents an indication that the lubricant supply is functioning.

In the context of performing a compressor operating function as a protective function, the compressor operational control unit 240 compares the function parameters determined in the context of the parameter determining function with reference parameters that are predetermined for the compressor operational control unit 240, in order to identify whether the value exceeds or falls below at least one of the reference parameters and this must where appropriate result in switching off the screw compressor.

For example, the compressor operational control unit 240 compares the pressure PN and the temperature TN on the input side or low-pressure side and the pressure PH and the temperature TH on the output side or high-pressure side with predetermined reference parameters, for example reference parameters defined by the values of limits of use of the screw compressor, and determines whether the screw compressor is operating within the provided use limit values.

Moreover, in the context of the protective function the compressor operational control unit 240 checks whether the lubricant presence signal SP is present and so whether there is sufficient supply of lubricant to the screw compressor 10.

In the context of performing a compressor operating function as a control function, the control sliders 52, 54 are moved in order to operate the screw compressor 10 in a particular operating state, in particular with a particular volume ratio and a particular output.

For the purpose of moving the control sliders 52 and 54 into the positions provided for this, the compressor operational control unit 240 starts from the actual positions POS1 and POS2 of the control sliders 52, 54 that are determined by the connection with the position determining device 152 and the evaluation device 192 in the context of the parameter determining function, in order, on the basis of having identified these positions POS1 and POS2, to move the control sliders 52, 54 in the positions defined by the desired operating state and to keep them there.

As illustrated in FIGS. 1, 2 and 15, the cylinder arrangements 112 and 132 are controllable using the control function of the compressor operational control unit 240, in order to position the control sliders 52, 54.

For this purpose, for example controllable by the compressor operational control unit 240, there are provided magnetic valves ML1 and ML2 in order to control the cylinder arrangement 112, and controllable magnetic valves MV1 and MV2 in order to control the cylinder arrangement 132.

This provides the possibility of positioning the control sliders 52, 54 with position control by the compressor operational control unit 240, that is to say moving exactly into and then maintaining positions of the control sliders 52, 54 that correspond for example to particular desired operating states of the screw compressor 10.

In the context of the control function as a compressor function, the compressor operational control unit 240 moreover also controls the supply of lubricant by the lubricant supply system 260 using the controllable valve 272.

The compressor operational control unit 240 moreover takes a form such that it can be connected to a controller of a drive motor 300, in particular an electric motor, for the purpose of driving the screw compressor 10 according to the invention, wherein the drive motor 300 is controlled for example by a motor controller 302 including in particular a frequency converter, such that the drive motor 300 can not only be switched on and off but can also be operated with speed control by the motor controller 302.

This makes it possible to use the compressor operational control unit 240 also to operate the drive motor 300 in dependence on the operating state of the screw compressor 10.

Preferably, the compressor unit according to the invention is operated by a system controller 310 that, in particular in the event of using the screw compressor 10 according to the invention in a cooling circuit or refrigerating circuit, transmits the output request made of the screw compressor 10 to the compressor operational control unit 240 by way of a communication unit 312.

The output request is defined at the system controller 310 on the one hand by the state variables of the stream of medium MN at low pressure passing through the screw compressor 10 and the stream of medium MH at high pressure guided out of the screw compressor, wherein, for example in the embodiment of the compressor unit illustrated in FIG. 15, the system controller 310 determines the pressure of the stream of medium MN at low pressure using the pressure sensor ASPN and the temperature of the stream of medium MN at low pressure using the temperature sensor ASTN.

Moreover, the system controller 310 determines the pressure of the medium MH at high pressure using the pressure sensor ASPH and the temperature of the medium MH at high pressure using the temperature sensor ASTH.

Based on these or, where appropriate, further sensor data or parameters, the system controller 310 determines a request signal AS that transmits them to the compressor operational controller 240 by way of the communication unit 312.

In this case, the compressor operational control unit 240 operates with a further compressor operating function, as an operating state predetermining function.

In this operating state predetermining function, the request variable AS and/or one or more of the function parameters determined in the context of the parameter determining function are used to establish operating states and to achieve and maintain these operating states by performing at least one of the control functions.

Here, possible function parameters are the positions POS1 and POS2 of the control sliders 52, 54 and the speed of rotation of the drive motor 300, and, taking as a starting point the operating states which are then achieved by the control function, the function parameters are then determined again using the parameter determining function, and furthermore, taking as a starting point these operating states, the protective function is performed, with monitoring of the individual function parameters and comparison of the function parameters with the reference parameters, as described above.

So that the determined function parameters for example can be shown to a person operating the compressor unit, the compressor operational control unit 240 communicates with a display unit 322, which is for example able to display the function parameters, either as such or by graphical elements such as bar charts or pie charts.

The display unit 322 is in particular furthermore also able to display further compressor operating functions, in particular with their performance state.

A further compressor operating function is an operating state monitoring function, in which the compressor operational control unit 240 records the performance of one or more compressor functions over time such that, for example in the event of a fault, the determined function parameters and/or the performed protective functions and/or the performed control functions and/or the operating states can be completed.

Figure 16:
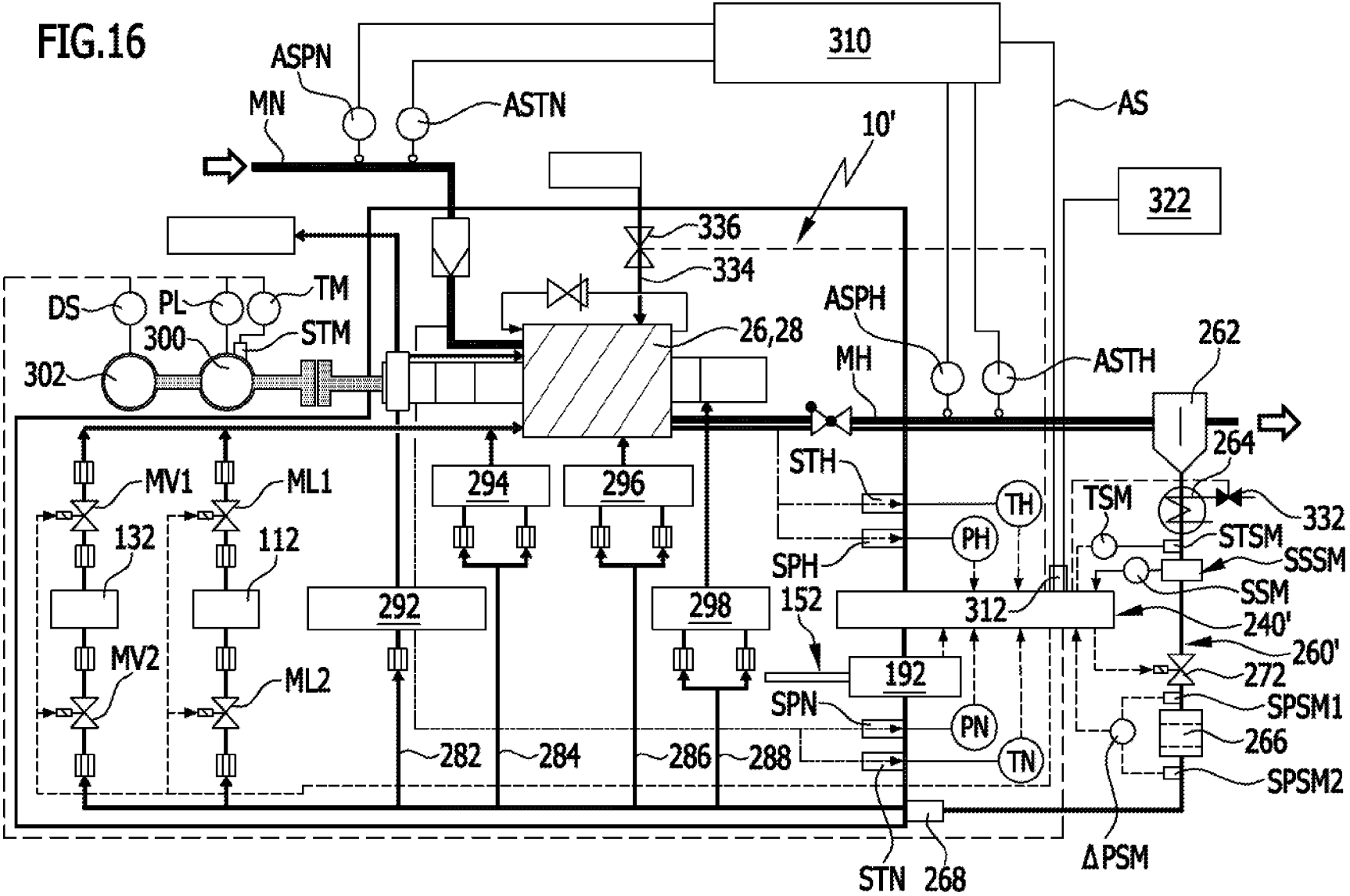
FIG. 16 shows an illustration similar to FIG. 15, of a second embodiment of a compressor unit.

In a second embodiment of a compressor unit according to the invention, illustrated in FIG. 16, the elements that are identical to those in the first exemplary embodiment are provided with the same reference numerals, so reference may be made to the entire content of the statements made in respect of the first embodiment for a description thereof.

In contrast to the first embodiment, in the second embodiment the vibration sensor SSW is not provided, and instead the speed signal DS is determined from the frequency at which the frequency converter of the motor controller 302 drives the drive motor 300.

Further, a temperature sensor STM is moreover associated with the drive motor 300, and this generates a temperature signal TM by way of which the compressor operational control unit 240' is able to determine the temperature of the drive motor 300.

Further, the phasing of the drive motor 300, that is to say its direction of rotation, is also determined by the compressor operational controller 240'.

Further, there is associated with the lubricant supply device 260' a sensor STSM that determines a temperature TSM of the lubricant supplied in the lubricant supply device 260', such that the compressor operational control unit 240' is also able to determine this temperature TSM of the lubricant.

Also arranged in the lubricant supply device 260' is a flow sensor SSSM that determines the flow rate of the lubricant and generates a signal for the lubricant flow rate SSM, by which the lubricant flow rate in the lubricant supply device 260' can be determined by the compressor operational control unit 240'.

The sensor for the lubricant flow rate SSSM may also take the form of a differential pressure sensor.

Moreover, associated with the lubricant filter 266 are pressure sensors SPSM1 and SPSM2, by which a differential pressure ΔPSM across the lubricant filter 266 is determinable, wherein the compressor operational control unit 240' also determines this differential pressure ΔPSM.

Preferably, in the lubricant supply system 260' the lubricant cooling unit 264 is further also controllable by a valve 332 that is likewise connected to the compressor operational control unit 240'.

Finally, there is also associated with the screw rotors 26, 28 an injection point 334 for compressed medium under high pressure, and this is controllable by a valve 336, wherein the injection of compressed medium under high pressure into the compressor volumes enclosed by the screw rotors makes possible additional cooling of the screw rotors 26, 28.

In the context of its parameter determining function, the compressor operational controller 240 also determines, in addition to the parameters enumerated in connection with the first embodiment, the speed of rotation DS of the frequency converter of the motor controller 302, the phasing PL of the drive motor 300, and indeed the temperature TM of the drive motor 300.

In addition, in the context of the parameter determining function of the compressor operational controller 240', in particular the temperature TSM of the lubricant in the lubricant supply device 260', the lubricant flow rate SSM, and the drop in pressure ΔPSM at the lubricant filter 266 of the lubricant supply device 260' are also determined.

In the context of the protective function, a comparison is for example made between the phasing PL of the drive motor 300 and the predetermined phasing, that is to say the envisaged direction of rotation, and a comparison is made between the temperature TM of the drive motor 300 and a reference value, and for example in the event of a discrepancy in the phasing PL from the predetermined phasing and/or in the event that the temperature TM exceeds the reference value, switch-off of the drive motor 300 by the motor controller 302 is triggered.

Moreover, in the context of the protective function the temperature TSM of the lubricant is monitored and compared with a reference value so that an excessive temperature of the lubricant can be identified.

Further, in the context of the protective function the lubricant flow rate SSM and/or the differential pressure ΔPSM at the lubricant filter 266 are determined and compared with a reference value so that it is possible to identify for example whether the lubricant flow rate SSM is sufficient or too low and for example whether the lubricant filter 266 is very dirty, such that in this case a warning is emitted, for example being displayed on the display unit 322.

In the context of the control function, in addition to the functions of the compressor operational control unit 240' above, the speed of rotation of the drive motor is also controlled by way of the frequency converter of the motor controller 302, and where appropriate the valve 332 of the lubricant cooling unit 264 is controlled to prevent the temperature TSM of the lubricant in the lubricant supply device 260' from becoming too high or indeed too low.

In addition, in the context of the control function the valve 324 for injecting refrigerant into the compressor volumes of the screw rotors 26, 28 is also controlled, in order to be able to cool these additionally where appropriate.

Figure 17:
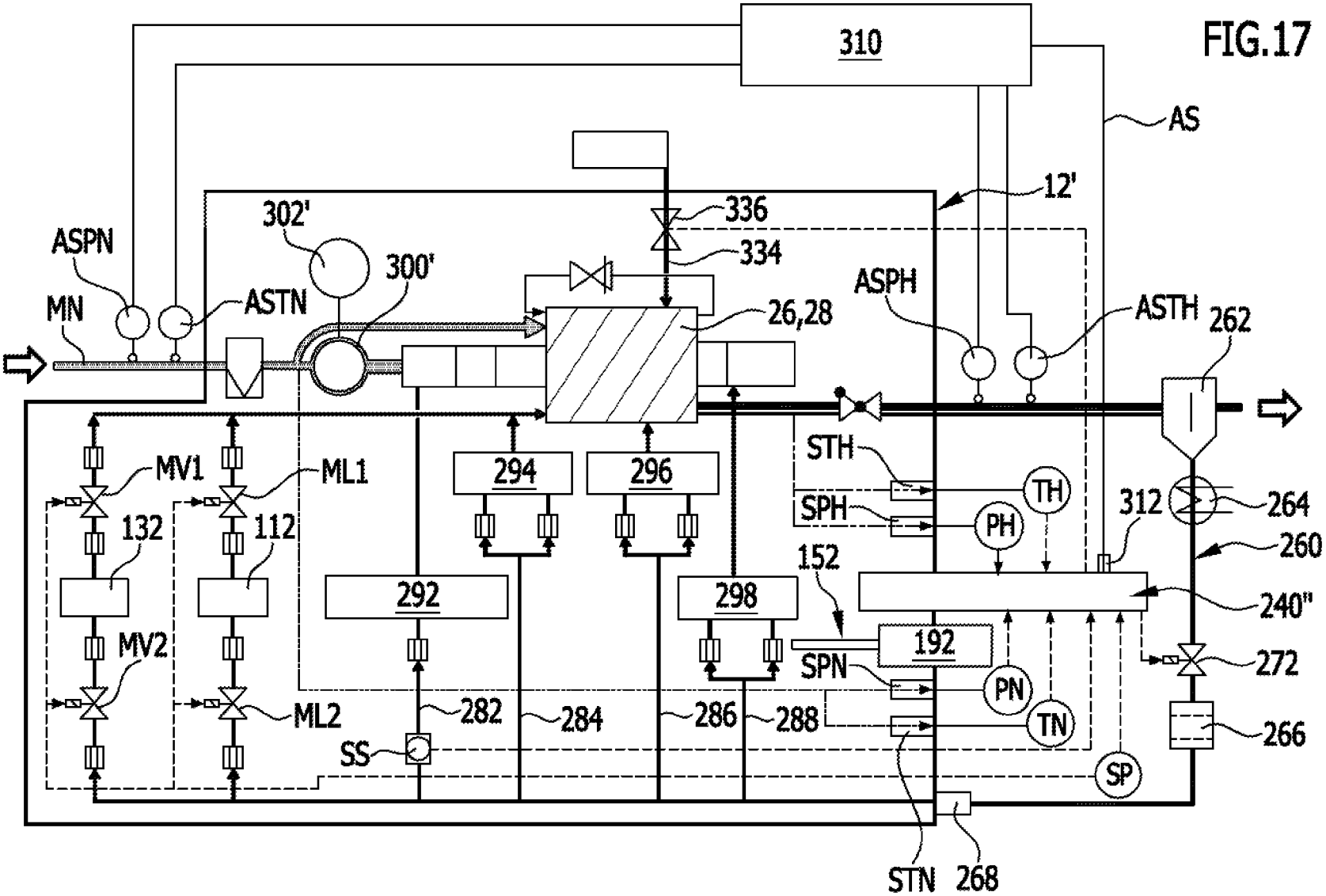
FIG. 17 shows an illustration similar to FIG. 15, of a third embodiment of a compressor unit.

In a third embodiment of the compressor unit, illustrated in FIG. 17, all the elements that are identical to those in the first and second exemplary embodiments are provided with the same reference numerals, so reference may be made to the entire content in respect of these for a description thereof.

In contrast to the first and second embodiments, in the third embodiment of the compressor unit the drive motor 300' is integrated into the compressor housing 12' and, for example for the purpose of cooling, the stream of medium MN at low pressure on the input side flows around it before being compressed by the screw rotors 26, 28.

The frequency converter having the motor controller 302' may be arranged on the compressor housing 12' in any desired manner.

In one case, for example, the frequency converter having the motor controller 302' is integrated into the compressor housing 12', and is thus always connected to the compressor operational control unit 240" such that the compressor operational control unit 240" can be permanently in communication with the frequency converter and receives, transmitted for example by the frequency converter, not only the speed of rotation DS of the drive motor 300 and the phasing PL thereof but in particular also the voltage UM at the drive motor 300 and the current consumption IM of the drive motor 300.

Otherwise, the compressor operational control unit 240" operates in the same way as that described in connection with the exemplary embodiments above, in particular the first exemplary embodiment.

The invention claimed is:

1. A compressor unit, comprising:

a screw compressor having a compressor housing that has a screw rotor chamber arranged in the compressor housing:

at least one screw rotor that is arranged in the screw rotor chamber, is mounted on the compressor housing to be rotatable about a screw rotor axis and receives a gaseous medium having an initial volume that is supplied by way of a low-pressure chamber arranged in the compressor housing and discharges the gaseous medium, compressed to a final volume, in the region of a high-pressure chamber arranged in the compressor housing; and two control sliders arranged in a slider channel of the compressor housing adjacent to the screw rotor, and movable in a direction of displacement parallel to the screw rotor axis;

a first control slider of the two control sliders is formed such that it affects the final volume, and a second control slider of the two control sliders is formed such that it affects the initial volume;

position determining device for the two control sliders that includes a first position indicator element coupled to the first control slider and a second position indicator element coupled to the second control slider;

wherein both position indicator elements interact with a common detector element that extends parallel to the direction of displacement of the two control sliders, and along which the first position indicator element and the second position indicator element are movable during movement of the two control sliders;

wherein the common detector element is coupled to an evaluation device that determines respective positions of the first position indicator element and the second position indicator element along the common detector element; and wherein there is provided, on the compressor housing, a compressor operational controller that performs a compressor operating function being an operation assisting function that assists at least one operation of the compressor unit.

2. A compressor unit according to claim 1, wherein the operation assisting function, that assists the at least one operation of the compressor unit, is a parameter determining function, and in that, for the purpose of performing the parameter determining function, determines at least one of the function parameters of:

pressure of the medium on an input side of the screw compressor, temperature of the medium on the input side of the screw compressor, pressure of the medium on an output side of the screw compressor, the respective positions of the two control sliders, lubricant temperature, lubricant flow rate, lubricant differential pressure at a lubricant filter, lubricant level in at least one lubricant supply line, speed of rotation of a drive motor, temperature of the drive motor, phasing of the drive motor, voltage at the drive motor, or current consumption of the drive motor.

3. The compressor unit according to claim 2, wherein a further compressor operating function is a protective function, in that for the purpose of performing the protective function at least one additional parameter determining function is performed and at least one of the function parameters is compared with at least one corresponding reference parameter, and if a value of the at least one of the function parameters exceeds or falls below that of the at least one corresponding reference parameter, a warning message is given and/or the screw compressor is switched off.

4. A compressor unit according to claim 1, wherein the operation assisting function, that assists the at least one operation of the compressor unit, is a control function, and in that, for the purpose of performing the control function, at least one of the following units is controlled:

a control slider drive, a motor controller, a lubricant cooling unit, an injection element for compressed medium for the purpose of additional cooling, or a slider controller for the two control sliders.

5. A compressor unit according to claim 1, wherein the operation assisting function, that assists the at least one operation of the compressor unit, is an operating state predetermining function in which a control function is performed on the basis of at least one request signal communicated to the compressor operational controller and/or at least one function parameter communicated to the compressor operational controller.

6. A compressor unit according to claim 1, wherein the operation assisting function, that assists the at least one operation of the compressor unit, is an operating state monitoring function, and for the purpose of performing the operating state monitoring function, a parameter detected by at least one parameter determining function and/or a result of at least one protective function and/or a control operation of at least one control function is recorded.

7. A compressor unit according to claim 6, wherein the recording of the parameter and/or a performance of at least one protective function and/or a performance of the at least one control function take place over time.

8. A compressor unit according to claim 1, wherein a communication unit exchanges data with external devices by a wired route or wirelessly.

9. A compressor unit according to claim 1, wherein the compressor operational controller is provided with at least one display unit that shows at least one performance state of at least one compressor operating function or the result thereof.

10. A compressor unit according to claim 1, wherein the screw compressor has a controller housing in which the compressor operational controller is arranged.

11. A compressor unit according to claim 10, wherein the controller housing is arranged on the compressor housing.

12. A compressor unit according to claim 1, wherein the screw compressor has two screw rotors that are arranged in the screw rotor chamber, are mounted on the compressor housing to be rotatable about the respective screw rotor axis, engage in one another by their helical contours and each interact with compression wall surfaces that are adjacent to and partly surround the helical contours in order to receive the gaseous medium having the initial volume that is supplied by way of the low-pressure chamber arranged in the compressor housing and to discharge the gaseous medium, compressed to the final volume, in the region of the high-pressure chamber arranged in the compressor housing, in that the gaseous medium is enclosed, at low pressure and with the initial volume, in compression chambers formed between the helical contours and compression wall surfaces adjacent thereto, and is compressed to the final volume at high pressure, wherein the least one control slider, which is arranged in the slider channel of the compressor housing, is adjacent to both screw rotors by slider compression wall surfaces, and is movable in the direction of displacement parallel to the screw rotor axes and takes the form such that it affects the final volume and/or the initial volume.

13. A compressor unit according to claim 1, wherein the common detector element is arranged in a detector channel that extends inside the compressor housing, parallel to the direction of displacement.

14. A compressor unit according to claim 13, wherein the first and second position indicator elements are arranged in the detector channel.

15. A compressor unit according to claim 1, wherein the first position indicator element is mechanically coupled to the first control slider by way of a connection body.

16. A compressor unit according to claim 1, wherein the first and second position indicator elements interact with the common detector element in a contactless manner.

17. A compressor unit according to claim 1, wherein the compressor operational controller controls a control slider drive for the two control sliders and determines the movement of the two control sliders using a position determining unit.

18. A compressor unit according to claim 17, wherein the compressor operational controller positions the two control sliders with position control.

19. A compressor unit according to claim 1, wherein, for determining the positions of at least one control slider, the compressor operational controller takes into account at least one of the following parameters:

pressure level on an input side at low pressure,
pressure level on an output side at high pressure,
temperature of the gaseous medium on the input side at low pressure, temperature of the gaseous medium on the output side at high pressure,
speed of rotation of the screw rotors,
power consumption of a drive motor, and
parameters of the gaseous medium.

20. A compressor unit according to claim 1, wherein the first control slider and the second control slider are arranged one behind the other in the direction of displacement thereof.

21. A compressor unit according to claim 20, wherein the first control slider and the second control slider have identical external contours.

22. A compressor unit according to claim 20, wherein the first control slider and the second control slider are positionable directly succeeding one another in a combined position and are movable together in the direction of displacement.

23. A compressor unit according to claim 20, wherein the first and the second control sliders are positionable in a separated position, spaced from one another, forming an intermediate space.

24. A compressor unit according to claim 1, wherein the first control slider has mutually directly adjacent slider compression wall surfaces, of which in each case one is adjacent to one of the screw rotors, and wherein the second control slider has slider compression wall surfaces that are arranged spaced from one another, of which in each case one is adjacent to one of the screw rotors.

25. A compressor unit according to claim 24, wherein the first control slider is arranged in contact with the second control slider.

26. A compressor unit according to claim 24, wherein slider compression wall surfaces of the first control slider and of the second control slider succeed one another.

27. The compressor unit according to claim 1, wherein the compressor operational controller is provided with a communication unit for exchanging data with external devices.

* * * * *